US008750738B2

(12) United States Patent
Hano et al.

(10) Patent No.: US 8,750,738 B2
(45) Date of Patent: Jun. 10, 2014

(54) IMAGE FORMING SYSTEM

(75) Inventors: Masami Hano, Abiko (JP); Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 200 days.

(21) Appl. No.: 13/459,596

(22) Filed: Apr. 30, 2012

(65) Prior Publication Data

US 2012/0288290 A1 Nov. 15, 2012

(30) Foreign Application Priority Data

May 11, 2011 (JP) ..... 2011-105841

(51) Int. Cl.
*G03G 15/22* (2006.01)
*G03G 15/23* (2006.01)
*G03G 15/20* (2006.01)

(52) U.S. Cl.
CPC ..... *G03G 15/238* (2013.01); *G03G 15/2078* (2013.01); *G03G 15/2039* (2013.01)
USPC ..... 399/69

(58) Field of Classification Search
CPC ..... G03G 15/238; G03G 2215/00021; G03G 2215/2083
USPC ..... 399/69
See application file for complete search history.

(56) References Cited

U.S. PATENT DOCUMENTS

| | | | | |
|---|---|---|---|---|
| 4,586,812 | A * | 5/1986 | Kaneko et al. | 355/24 |
| 7,024,152 | B2 | 4/2006 | Lofthus et al. | |
| 7,245,838 | B2 * | 7/2007 | Swift | 399/8 |
| 2012/0224876 | A1 * | 9/2012 | Nakayama et al. | 399/69 |

FOREIGN PATENT DOCUMENTS

| | | | |
|---|---|---|---|
| JP | 6-343125 | A | 12/1994 |
| JP | 2006-58881 | A | 3/2006 |

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

A multiply-connecting image forming system in which a second image forming apparatus forms an image on a recording material on which an image has been formed by a first image forming apparatus, the multiply-connecting image forming system suppressing degradation in quality of an output image when only the second image forming apparatus continues duplex image formation because the first image forming apparatus has run out of toner during the duplex image formation.

5 Claims, 13 Drawing Sheets

100

IMAGE FORMING SYSTEM

BACKGROUND OF THE INVENTION

1. Field of the Invention

The present invention relates to an image forming system, and more particularly, to an image transfer control, in a multiply-connecting image forming system capable of subjecting a recording material having an image formed thereon by a first image forming apparatus to image formation by a second image forming apparatus, for the second image forming apparatus in a case where only the second image forming apparatus continues image formation.

2. Description of the Related Art

There is widely used an image forming apparatus in which a toner image forming portion forms a toner image and transfers the toner image onto a recording material, and then a fixing portion heats and pressurizes the recording material to fix the image onto the recording material. Further, there is widely used an image forming apparatus capable of performing duplex printing, including a reverse conveyance mechanism configured so that the recording material having an image formed thereon by the toner image forming portion and the fixing portion is sent again to the same toner image forming portion in a state in which a front surface and a back surface of the recording material are reversed.

In Japanese Patent Application Laid-Open No. 2006-58881, there is proposed a multiply-connecting image forming system constructed by connecting, through intermediation of a conveyance path, two image forming apparatus, that is, a first image forming apparatus and a second image forming apparatus, which each include the reverse conveyance mechanism and are capable of solely performing duplex printing. In this case, the conveyance path is provided with a switchback reverse conveyance mechanism for a recording material, to thereby deliver the recording material from the first image forming apparatus to the second image forming apparatus in a state in which a leading edge and a trailing edge of the recording material are reversed.

The individual image forming apparatus successively perform front surface printing and back surface printing in a divided manner, to thereby greatly increase printing speed as compared to a case where a single image forming apparatus is used to perform duplex printing with use of its reverse conveyance mechanism.

In the multiply-connecting image forming system described above, a large capacity recording material deck is, in many cases, arranged on an upstream side of the two image forming apparatus. In a case where the image forming apparatus on the upstream side has run out of toner during duplex image formation using the large capacity recording material deck, it is conceived that the recording material is caused to pass through the image forming apparatus on the upstream side to continue the duplex image formation using only the image forming apparatus on the downstream side without performing image formation by the image forming apparatus on the upstream side.

In this case, however, the recording material, which has passed through the fixing device at the fixing temperature one time, is reduced in amount of water contained therein. Therefore, the image forming apparatus on the downstream side needs to be set in an appropriate transfer condition, which may otherwise lead to degradation in quality of an output image obtained through the image formation on the downstream side.

SUMMARY OF THE INVENTION

The present invention has an object to prevent, in an image forming system, in particular, a multiply-connecting image forming system capable of subjecting a recording material having an image formed thereon by a first image forming apparatus to image formation by a second image forming apparatus, degradation in quality of an output image in a case where the first image forming apparatus has run out of toner during duplex image formation and in a case where only the second image forming apparatus continues image formation.

According to an exemplary embodiment of the present invention, there is provided an image forming system having the following configuration.

That is, the image forming system includes:

a first image forming apparatus having: a first image forming portion configured to form an image; a first transfer unit configured to transfer, onto a recording material, the image formed by the first image forming portion; a first transfer power source configured to apply a voltage to the first transfer unit; and a first thermal fixing unit configured to thermally fix the image onto the recording material;

a second image forming apparatus having: a second image forming portion configured to form an image; a second transfer unit configured to transfer, onto a recording material, the image formed by the second image forming portion; a second transfer power source configured to apply a voltage to the second transfer unit; and a second thermal fixing unit configured to thermally fix the image onto the recording material;

a recording material containing portion configured to contain a recording material to be conveyed to the first transfer unit;

a conveying unit configured to convey the recording material from the first image forming apparatus to the second image forming apparatus;

a duplex image forming mode executing unit configured to execute:

a first duplex image forming mode in which the first image forming apparatus forms an image on one surface of the recording material which is conveyed from the recording material containing portion, and then the conveying unit conveys the recording material, and the second image forming apparatus forms an image on another surface of the recording material; and a second duplex image forming mode in which the second image forming apparatus sequentially forms images on one surface and another surface of a recording material which is conveyed from the recording material containing portion to the second image forming apparatus via the first image forming apparatus and the conveying unit;

a determining unit configured to determine whether or not the first image forming portion has run out of toner and whether or not the second duplex image forming mode is executable; and a control unit configured to control an absolute value of the voltage of the second transfer power source in a manner that, when the determining unit determines, during a period in which the duplex image forming mode executing unit executes the first duplex image forming mode, that the first image forming portion has run out of toner and that the second duplex image forming mode is executable, and when the duplex image forming mode executing unit changes over the first duplex image forming mode to the second duplex image forming mode to continue duplex image formation, the control unit makes an absolute value of the voltage of the second transfer power source when transferring the image onto the one surface of the recording material larger than an absolute value of the voltage of the first transfer power source in the first duplex image forming mode, and the control unit makes an absolute value of the voltage of the second transfer power source when transferring the image onto the another surface of the recording material larger than an absolute value of the voltage of the second transfer power source in the first duplex image forming mode.

According to the image forming system of the present invention, in the case where the image forming apparatus on the upstream side has run out of toner during duplex image formation and only the image forming apparatus on the downstream side continues the duplex image formation in the multiply-connecting image forming system, the image defect can be prevented through the application of an appropriate transfer voltage.

Further features of the present invention will become apparent from the following description of exemplary embodiments with reference to the attached drawings.

DESCRIPTION OF THE EMBODIMENTS

Hereinafter, an embodiment mode of the present invention will be described in detail with reference to the drawings. The embodiment mode of the present invention is applicable to a case where an image forming apparatus on an upstream side has run out of toner at the time of duplex printing and therefore the image forming apparatus for the duplex printing is automatically changed over to an image forming apparatus on a downstream side. The embodiment mode is replaceable with another embodiment mode in which components of the embodiment mode are partially or entirely substituted with alternative components.

A toner image forming portion is enabled regardless of full color/monochrome, single-drum color type, one-component developer/two-component developer, direct transfer method/recording material conveyance method/intermediate transfer method, charging methods, exposure methods, kinds of a photosensitive member, and the like, as long as the image forming apparatus has a configuration and housing that enables image formation through connection to another image forming apparatus. There may be employed an arrangement configuration in which two independent image forming apparatus are connected to each other through intermediation of a relay unit, as well as an arrangement configuration in which two independent image forming apparatus are directly connected to each other. The image forming apparatus may be used for various purposes, such as a printer, various printing machines, a copying machine, a facsimile machine, and a multifunction peripheral, through addition of necessary devices, equipment, and housing configurations.

(Multiply-Connecting Image Forming Apparatus)

Figure 1:
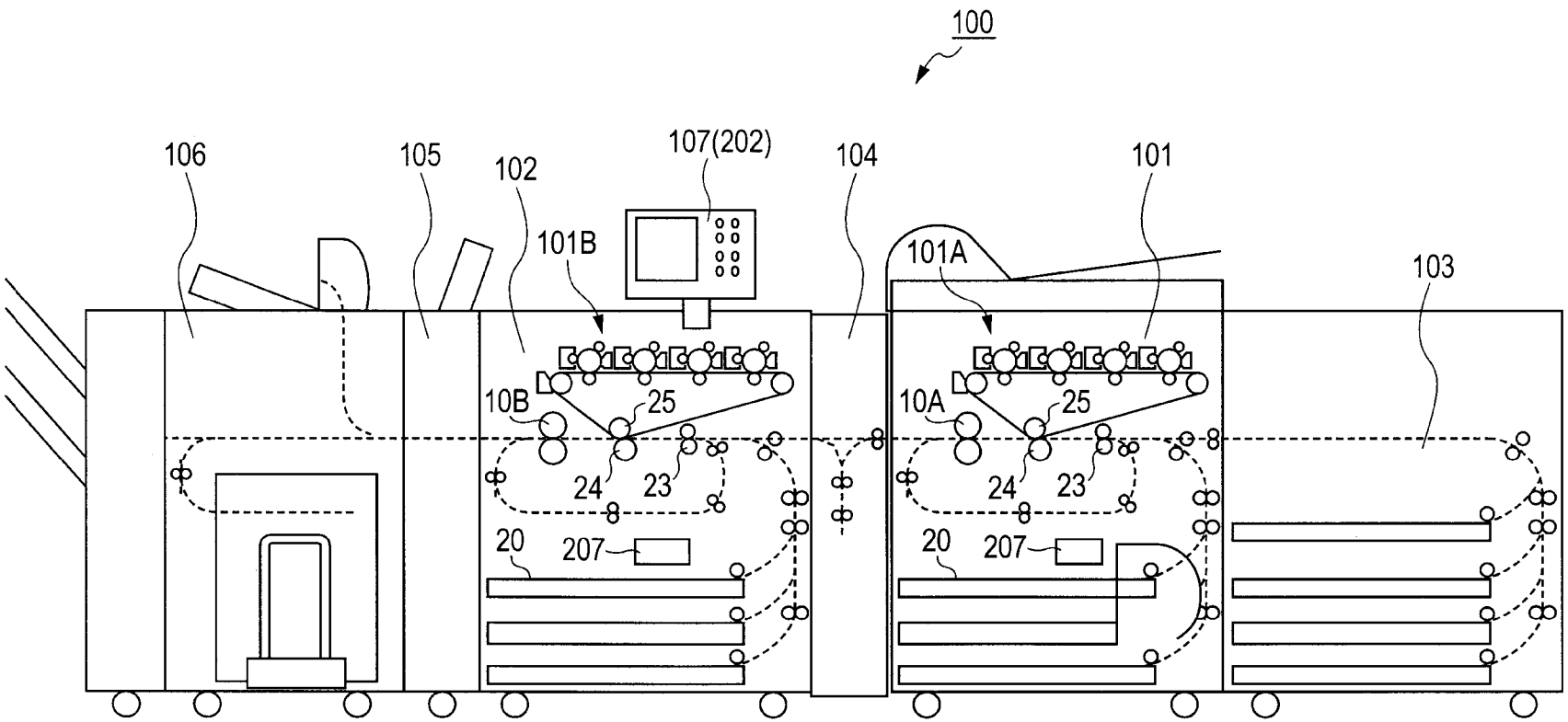
FIG. 1 is an explanatory diagram illustrating a configuration of a multiply-connecting image forming apparatus.

FIG. 1 is an explanatory diagram illustrating a configuration of a multiply-connecting image forming apparatus.

As illustrated in FIG. 1, in a first image forming apparatus 101, a toner image forming portion 101A as an example of a first toner image forming portion forms a toner image on a recording material, and a fixing device 10A (first thermal fixing unit) as an example of a first fixing portion fixes the toner image onto the recording material. In a second image forming apparatus 102, a toner image forming portion 101B as an example of a second toner image forming portion forms a toner image on a recording material, and a fixing device 10B (second thermal fixing unit) as an example of a second fixing portion fixes the toner image onto the recording material.

A large capacity deck 103 (recording material containing portion) as an example of a first feeding portion feeds and conveys a recording material to the toner image forming portion 101A. A relay unit 104 as an example of a conveyance path conveys the recording material having passed through the toner image forming portion 101A and the fixing device 10A to the toner image forming portion 101B.

In a multiply-connecting image forming system 100, the first image forming apparatus 101 and the second image forming apparatus 102 of the same type are connected to each other through intermediation of the relay unit 104, and the first image forming apparatus 101 and the second image forming apparatus 102 executes printing on respective one sides of a recording material in a divided manner for duplex printing. The large capacity deck 103 is disposed upstream of the first image forming apparatus 101, and an inserter 105 and a large capacity stacker 106 are connected downstream of the second image forming apparatus 102. On an upper panel of the second image forming apparatus 102, there is disposed an external display apparatus 107 for an operator to execute settings and operations for image formation.

The large capacity deck 103 is a unit capable of storing a larger number of recording materials than recording material cassettes 20 installed in main bodies of the first image forming apparatus 101 and the second image forming apparatus 102. The recording material cassettes 20 built into the image forming apparatus each include two stages of 500-sheet cassettes capable of storing one pack of cut paper constituted by 500 sheets of A3 paper having a basis weight of 80 g/m$^2$, and one stage of 1,000-sheet cassette capable of storing two packs of cut paper. That is, the recording material cassettes 20 are each capable of storing 2,000 sheets in total. On the other hand, the large capacity deck 103 includes three stages of 2,000-sheet decks, and is therefore capable of storing 6,000 sheets in total.

In FIG. 1, a single large capacity deck 103 is connected. A large capacity deck 103 of the same type may be additionally provided upstream of the above-mentioned large capacity deck 103, and thus a larger number of recording materials may be stored therein. The multiply-connecting image forming system 100 is capable of outputting 2,100 sheets of A3 paper per hour in duplex printing. Therefore, the single large capacity deck 103 allows continuous operation of approximately two hours, and four or more large capacity decks 103 connected together allow continuous operation of eight hours or longer.

Further, in FIG. 1, a single large capacity stacker 106 is connected. A large capacity stacker 106 of the same type may be additionally provided downstream of the above-mentioned large capacity stacker 106. In the large capacity stacker 106, a delivery tray for confirmation of test printing is disposed in an upper surface portion thereof in addition to a stacking portion. The stacking capacity of the single large capacity stacker 106 is 6,000 sheets of A3 paper. Therefore, the large capacity stacker 106 has stacking performance corresponding to the storage performance of the single large capacity deck 103.

Therefore, when the same number of the large capacity stackers 106 as that of the large capacity decks 103 is additionally provided, a continuous unattended operation is enabled while securing a stacking space for print outputs until all the recording materials are used up.

The inserter 105 is a unit to be used for outputting a printed matter by inserting several pages other than black and white output pages into the printed matter. The inserter 105 is a unit for inserting insertion pages of, for example, a full-color printed matter that is printed in advance at predetermined locations of a bundle of stacked recording materials, and is used as necessary.

In recent years, the image forming apparatus has been required to have higher speed and higher energy efficiency. To meet such need on the image forming apparatus, there is proposed a multiply-connecting image forming system, in which a relay unit is provided between multiple image forming apparatus to perform image formation. The multiply-connecting image forming system includes multiple sets of devices installed for charging, exposure, development, transfer, fixing, and cleaning. Therefore, an image is formed on the first surface of the recording material by the first image forming apparatus, and after that, the recording material is reversed, and another image is formed on the second surface of the recording material by the second image forming apparatus. Accordingly, the number of output pages in duplex printing can be doubled as compared to the number of output pages in duplex printing performed by a single image forming apparatus.

As described in Japanese Patent Application Laid-Open No. H06-343125, the multiply-connecting image forming system is constructed by connecting, through intermediation of a relay unit, two image forming apparatus which solely function as an image forming apparatus. Accordingly, the multiply-connecting image forming system can be easily commercialized without a large-scale change in hardware design. In the multiply-connecting image forming system, the large capacity deck, post-processing apparatus, and the like are arrangeable upstream and downstream of the system, as compared to the system in which the image forming apparatus are connected in parallel for use. Those peripheral applications are shared to perform in-line processing, which provides an advantage in terms of reduction in space to be occupied and cost for introduction.

The multiply-connecting image forming system 100 is provided with a first duplex image forming mode, in which the first image forming apparatus 101 and the second image forming apparatus 102 are used for duplex printing, and a second duplex image forming mode, in which only the second image forming apparatus 102 is used for duplex printing.

The multiply-connecting image forming system 100 is capable of performing image formation in which an image is formed on the first surface of a recording material P by the first image forming apparatus 101, and after that, the recording material P is reversed by the relay unit 104, and another image is formed on the second surface of the recording material P by the second image forming apparatus 102. Accordingly, the number of output pages per hour in duplex printing can be doubled as compared to the number of output pages per hour in duplex printing performed by the single first image forming apparatus 101 or the single second image forming apparatus 102, with the result that the speed of duplex printing can be increased.

In the multiply-connecting image forming system 100, another large capacity deck may be arranged further upstream of the first image forming apparatus 101, and a special image forming apparatus for a transparent or gold/silver printing and a post-processing apparatus may be arranged further downstream of the second image forming apparatus 102. Therefore, those peripheral applications are shared to perform in-line processing, which provides an advantage in terms of reduction in space to be occupied and cost for introduction.

(Image Forming Apparatus)

Figure 2:
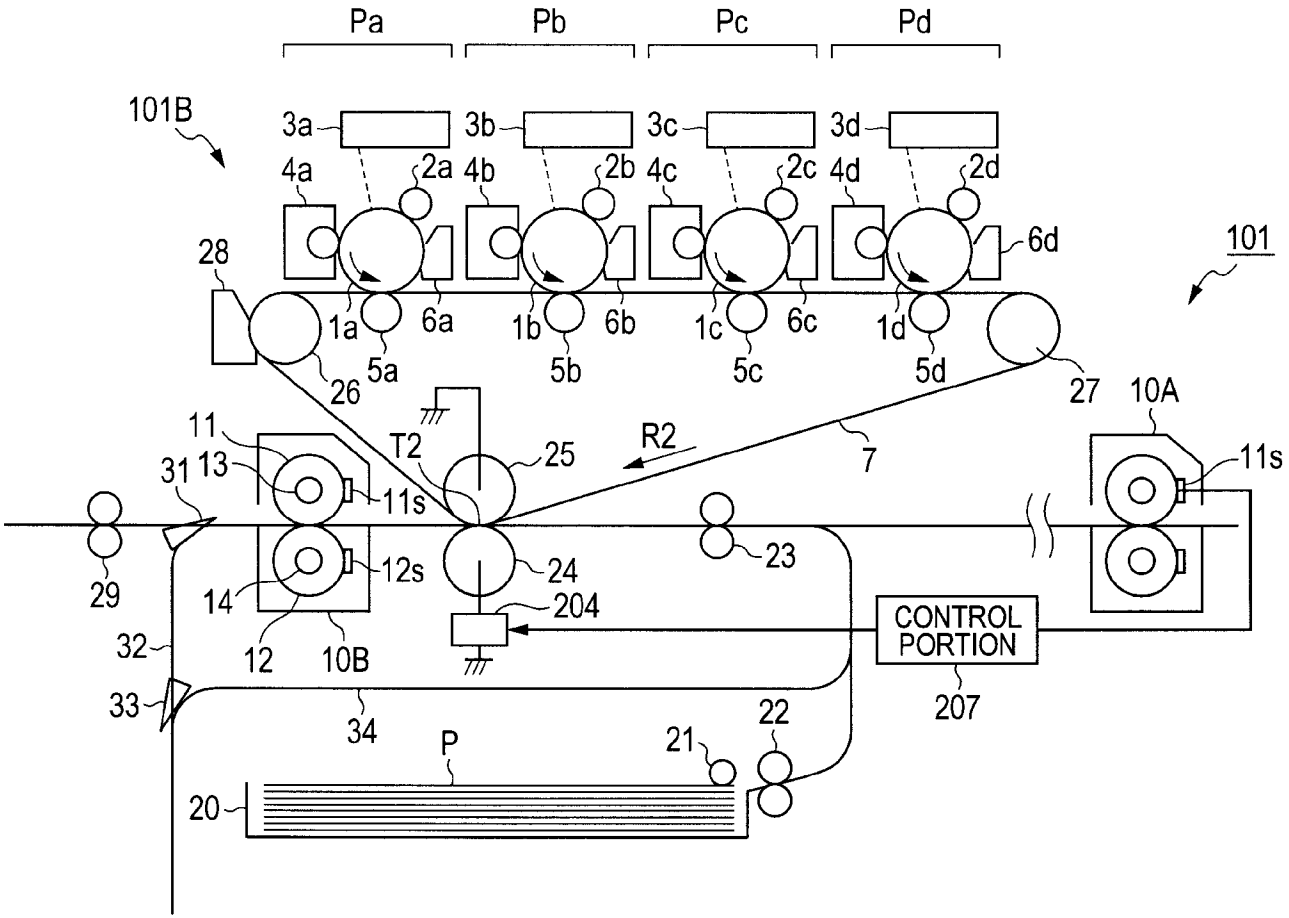
FIG. 2 is an explanatory diagram illustrating a configuration of a second image forming apparatus of the multiply-connecting image forming apparatus.

FIG. 2 is an explanatory diagram illustrating a configuration of the second image forming apparatus. In this section, the configuration and operation of the second image forming apparatus 102 will be described, and redundant description on the first image forming apparatus 101 of the same type is therefore omitted herein.

As illustrated in FIG. 2, a back surface printing conveyance path 34 as an example of a reverse conveyance mechanism sends the recording material having an image formed thereon by the toner image forming portion (image forming portion) 101B and the fixing device (fixing unit) 10B to the toner image forming portion 101B again in a state in which the front surface and the back surface of the recording material are reversed. The second image forming apparatus 102 includes the recording material cassette 20 (recording material containing cassette) for feeding and conveying a recording material to the toner image forming portion (image forming portion) 101B without causing the recording material to pass through the fixing device 10B.

The second toner image forming portion (second image forming portion) 101B employs a tandem intermediate transfer method, in which yellow, magenta, cyan, and black image forming portions Pa, Pb, Pc, and Pd are arrayed along an intermediate transfer belt 7. The intermediate transfer belt 7 is looped and supported around a drive roller 27, a tension roller 26, and an opposed roller 25, and is driven by the drive roller 27 to rotate in the direction indicated by the arrow R2. In the image forming portion Pa, a yellow toner image is formed and transferred onto the intermediate transfer belt 7. In the image forming portion Pb, a magenta toner image is formed and transferred onto the intermediate transfer belt 7. In the image forming portions Pc and Pd, a cyan toner image and a black toner image are formed, respectively, and transferred onto the intermediate transfer belt 7.

The four-color toner images transferred onto the intermediate transfer belt 7 are conveyed to a secondary transfer portion T2, and are secondarily transferred onto the recording material P. The recording material P, which is fed and conveyed from the recording material cassette 20 and is waiting at registration rollers 23, is sent out to the secondary transfer portion T2 by the registration rollers 23 at a timing synchronized with a timing of conveyance of the toner images on the intermediate transfer belt 7. The recording material P, which is nipped and conveyed through the secondary transfer portion T2 to have the toner images transferred thereto, is heated and pressurized by the second fixing device 10B so that the toner images are fixed to the surface of the recording material P. The toner which has not been transferred onto the recording material P and adheres to the intermediate transfer belt 7 is collected by a belt cleaning device 28.

In a simplex printing mode executed solely by the second image forming apparatus 102, the recording material P having the toner images fixed thereto is directly delivered outside the second image forming apparatus 102 through delivery rollers 29. On the other hand, in a duplex printing mode executed solely by the second image forming apparatus 102, a flapper 31 is shifted so that the recording material P having the toner images fixed thereto is sent to a vertical conveyance path 32. Then, the recording material P is switchback-conveyed along with an operation of a flapper 33, and is therefore sent to the back surface printing conveyance path 34. Then, the recording material P is sent to the secondary transfer portion T2 again in a state in which the front surface and the back surface of the recording material P are reversed, and the toner images are transferred also to the back surface of the recording material P. After that, the second fixing device 10B fixes the toner images on the back surface, and the recording material P having images formed on both surfaces thereof is delivered outside through the delivery rollers 29.

The image forming portions Pa, Pb, Pc, and Pd have substantially the same configuration except that the colors of toner to be used in development devices 4*a*, 4*b*, 4*c*, and 4*d* are different from one another. In the following, the image forming portion Pa will be described, and the image forming portions Pb, Pc, and Pd are deemed to be described with the symbol "a" at the end of the reference symbol of each component of the image forming portion Pa being replaced with the symbols "b", "c", and The image forming portion Pa includes a charging roller 2*a*, an exposure device 3*a*, a development device 4*a*, a transfer roller 5*a*, and a drum cleaning device 6*a*, which are arranged around a photosensitive drum 1*a*. The photosensitive drum 1*a* includes a photosensitive layer formed on an outer peripheral surface of an aluminum cylinder, and rotates in the direction indicated by the arrow of FIG. 2. The photosensitive drum 1*a* is formed to have a diameter of approximately 84 mm, and is driven to rotate about a central support shaft in the direction indicated by the arrow of FIG. 2 (counterclockwise) at a circumferential speed of 300 mm/sec.

The charging roller 2*a* is applied with a DC voltage on which an AC voltage is superimposed, thereby charging the surface of the photosensitive drum 1*a* to a uniform potential. The exposure device 3*a* scans, by a rotation mirror, a laser beam generated using a semiconductor laser, thereby reducing a surface potential of the charged photosensitive layer of the photosensitive drum 1*a* at an exposed part. Accordingly, an electrostatic image of an original image is formed on the photosensitive drum 1*a*.

The development device 4*a* causes a development sleeve to carry charged two-component developer containing a magnetic carrier and nonmagnetic toner in a mixed manner, and thus the electrostatic image on the photosensitive drum 1*a* is developed to form a toner image on the surface of the photosensitive drum 1*a*. In order to replenish toner consumed along with the image formation, a toner supply apparatus (not shown) replenishes toner in the development device 4*a*. The transfer roller (transfer unit) 5*a* is applied, from a transfer power source, with a DC voltage having an opposite polarity to the charging polarity of the toner, and thus the toner image born on the photosensitive drum 1*a* is transferred onto the intermediate transfer belt 7 that is nipped and rotated by the photosensitive drum 1*a* and the transfer roller 5*a*. The drum cleaning device 6*a* collects transfer residue toner which has not been transferred onto the intermediate transfer belt 7 and remains on the photosensitive drum 1*a*.

Note that, the exposure device 3*a* may be formed with use of an LED array or the like. The first image forming apparatus 101 described above is assumed as a color image forming apparatus, but the present invention is not limited thereto, and a monochrome image forming apparatus may also be applicable.

(Developer)

The development device 4*a* uses two-component developer having a toner concentration (TD ratio) of 8%, in which toner and a carrier are mixed at a weight ratio of approximately 8:92. The toner has an average particle size of approximately 6 μm, which is prepared by kneading a resin binder mainly containing polyester with a pigment and subjecting the resultant to pulverization and classification. For the carrier, for example, metals such as unoxidized iron, nickel, cobalt, manganese, chromium, and rare earths, alloys thereof, or oxidized ferrite may be suitably used in a surface oxidation region of the carrier. The production method for the magnetic particles described above is not particularly limited. The carrier has a volume-average particle size of 20 μm to 50 μm, preferably 30 μm to 40 μm, and has a resistivity of $10^7$ Ωcm or more, preferably $10^8$ Ωcm or more. In this case, a carrier prepared by coating a core mainly containing ferrite with a silicon resin is used, and has a volume-average particle size of 35 μm, a resistivity of $5\times10^9$ Ωcm, and a magnetization intensity of 200 emu/cc.

(Fixing Device)

The second fixing device 10B (second thermal fixing unit) includes a fixing roller 11 and a pressure roller 12, which abut against each other to form a heating nip for the recording material. The fixing roller 11 is driven by a drive source (not shown) to rotate in a predetermined rotation direction at a predetermined rotation speed. The fixing roller includes a cylindrical core bar made of aluminum and having an outer diameter of 74 mm, a thickness of 6 mm, and a length of 350 mm. The core bar is covered with an elastic layer made of silicone rubber and having a JIS-A hardness of 15 degrees and a thickness of 3 mm. The elastic layer is covered with a release layer formed of a tube made of a fluorine resin (perfluoroalkoxy resin: PFA) and having a thickness of 100 μm so as to enhance the releasability of toner from the elastic layer.

A halogen heater 13 having a normal rated power of 1,500 W is arranged inside the core bar of the fixing roller 11, and a surface temperature of the fixing roller 11 is detected by a thermistor 11*s* (temperature detecting unit). A temperature changing unit controls power feeding to the halogen heater 13 so that the detected surface temperature of the fixing roller 11 becomes a predetermined target temperature of 200° C.

The pressure roller 12 has both end portions pressurized by a pressure mechanism (not shown) toward the fixing roller 11 with a predetermined total pressure to form a heating nip having a length of 10 mm in a conveyance direction. The pressure roller 12 is rotated in association with the fixing roller 11. The pressure roller 12 includes a cylindrical core bar made of stainless steel and having an outer diameter of 54 mm, a thickness of 3 mm, and a length of 350 mm. The core bar is covered with an elastic layer made of silicone rubber and having a JIS-A hardness of 20 degrees and a thickness of 3 mm. The elastic layer is covered with a release layer formed of a tube made of a fluorine resin and having a thickness of 100 μm so as to enhance the releasability of toner from the elastic layer at the time of back surface printing.

A halogen heater 14 having a normal rated power of 400 W is arranged inside the core bar of the pressure roller 12, and a surface temperature of the pressure roller is detected by a thermistor 12*s*. The temperature changing unit controls power feeding to the halogen heater 14 so that the detected surface temperature of the pressure roller 12 becomes a predetermined target temperature of 150° C.

(Image Transfer Control)

Each image forming apparatus includes the transfer power source configured to apply a voltage to a secondary transfer roller (transfer unit) 24.

Figure 3:
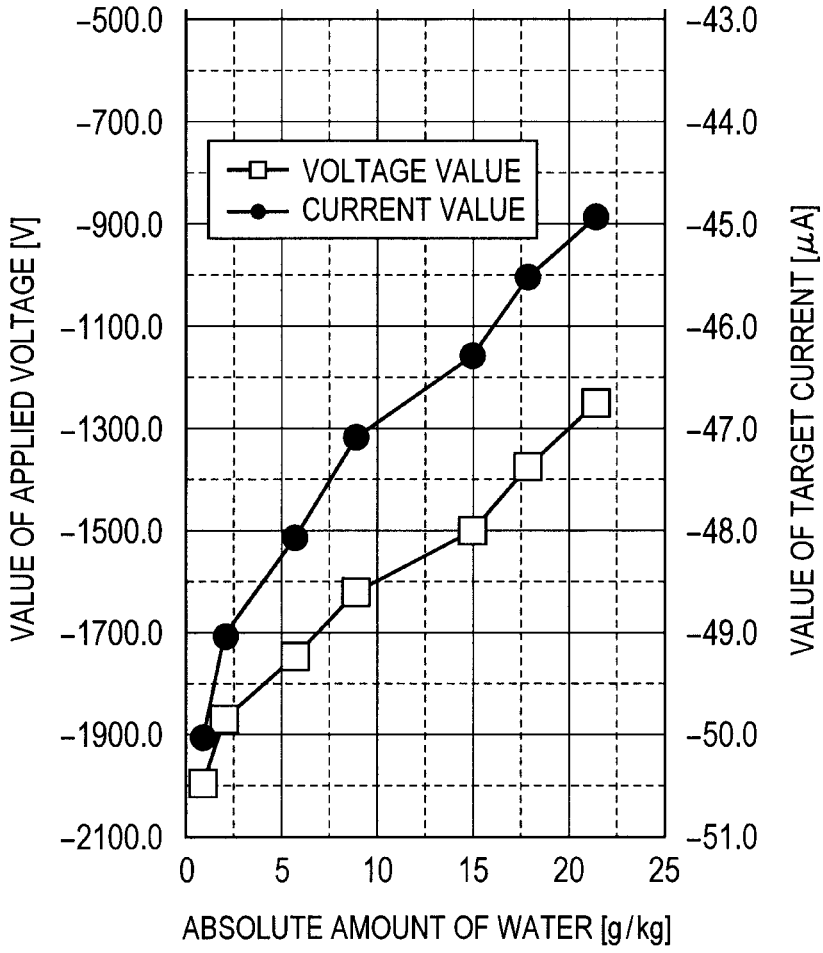
FIG. 3 is an explanatory graph showing a relationship between temperature and humidity in a surrounding environment and a required secondary transfer voltage.
Figure 4:
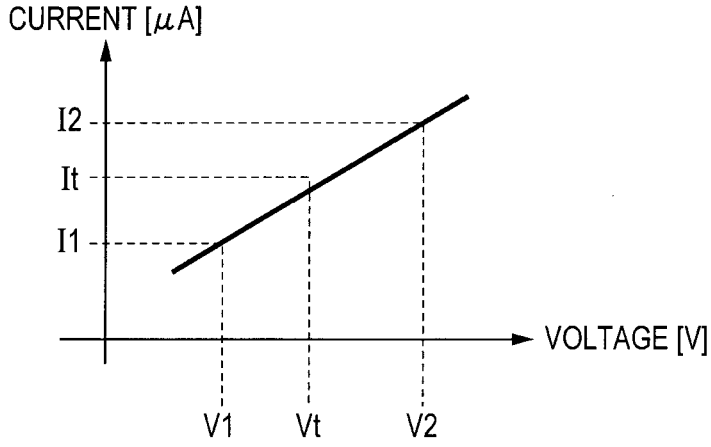
FIG. 4 is an explanatory graph showing auto transfer voltage control (ATVC).

FIG. 3 is an explanatory graph showing a relationship between temperature and humidity in a surrounding environment and a required secondary transfer voltage. FIG. 4 is an explanatory graph showing auto transfer voltage control (ATVC).

As shown in FIG. 3, in the second image forming apparatus 102 that employs an electrophotographic process, when the temperature and humidity in the periphery of the second toner image forming portion 101B change, a current value It of the transfer voltage required to transfer the toner image from the intermediate transfer belt 7 onto the recording material changes. Even when the current value It of the transfer voltage is constant, the resistance value of the secondary transfer roller 24 changes due to the changes in temperature and humidity and changes over time. Therefore, a voltage value Vtr of the voltage to be applied to the secondary transfer roller 24 changes so that a current having a desired current value It is caused to flow at the time of image formation. Therefore, the second image forming apparatus 102 executes ATVC at a predetermined timing of non-image formation, to thereby set the voltage value Vtr of the transfer voltage to be applied to the secondary transfer roller 24 at the time of image formation.

As shown in FIG. 4, in order to set a voltage value Vt for the desired current value It, a control portion (voltage changing unit) 207 of the second image forming apparatus 102 measures current values I1 and I2 at the time of applying voltages V1 and V2. The current values I1 and I2 are obtained at several high and low measurement points with respect to the desired current value It. Then, linear interpolation is performed on (voltage V1, current value I1) and (voltage V2, current value I2) to determine the voltage value Vt for the desired current value It. In this manner, the current values I1 and I2 of currents flowing through the secondary transfer portion T2 in a state in which no recording material is present are determined corresponding to the preset voltages V1 and V2, and the values are subjected to linear interpolation. Thus, the following relational expression is obtained.

$$I = \left(\frac{I_2 - I_1}{V_2 - V_1}\right)x + \left(\frac{V_2 I_1 - V_1 I_2}{V_2 - V_1}\right) \quad \text{(Expression 1)}$$

Then, in order to obtain the desired current value It, the voltage value Vt of the voltage to be applied to the secondary transfer roller 24 is determined by the following expression.

$$Vt = \left[I_t - \left(\frac{V_2 I_1 - V_1 I_2}{V_2 - V_1}\right)\right] * \left(\frac{V_2 - V_1}{I_2 - I_1}\right) \quad \text{(Expression 2)}$$

Then, a value of a recording material sharing voltage Vp is added to the voltage value Vt in the state in which no recording material is present, and accordingly the voltage value Vtr of the voltage to be applied to the secondary transfer roller 24 at the time of image formation is determined.

$$Vtr = Vt + Vp \quad \text{(Expression 3)}$$

In this case, the recording material sharing voltage Vp varies depending on a combination of the type of the recording material and the amount of contained water. The amount of contained water varies depending on a combination of the type of the recording material and the temperature and humidity in the surrounding environment. Therefore, a control apparatus 202 includes, in a storage portion 213 thereof, a table in which the recording material sharing voltage Vp is set for each combination of the type of the recording material and the temperature and humidity in the surrounding environment, to thereby determine the recording material sharing voltage Vp in accordance with the combination of the setting contents of the type of the recording material and the temperature and humidity in the surrounding environment of the recording material.

(Control Apparatus and External Display Apparatus)

Figure 5:
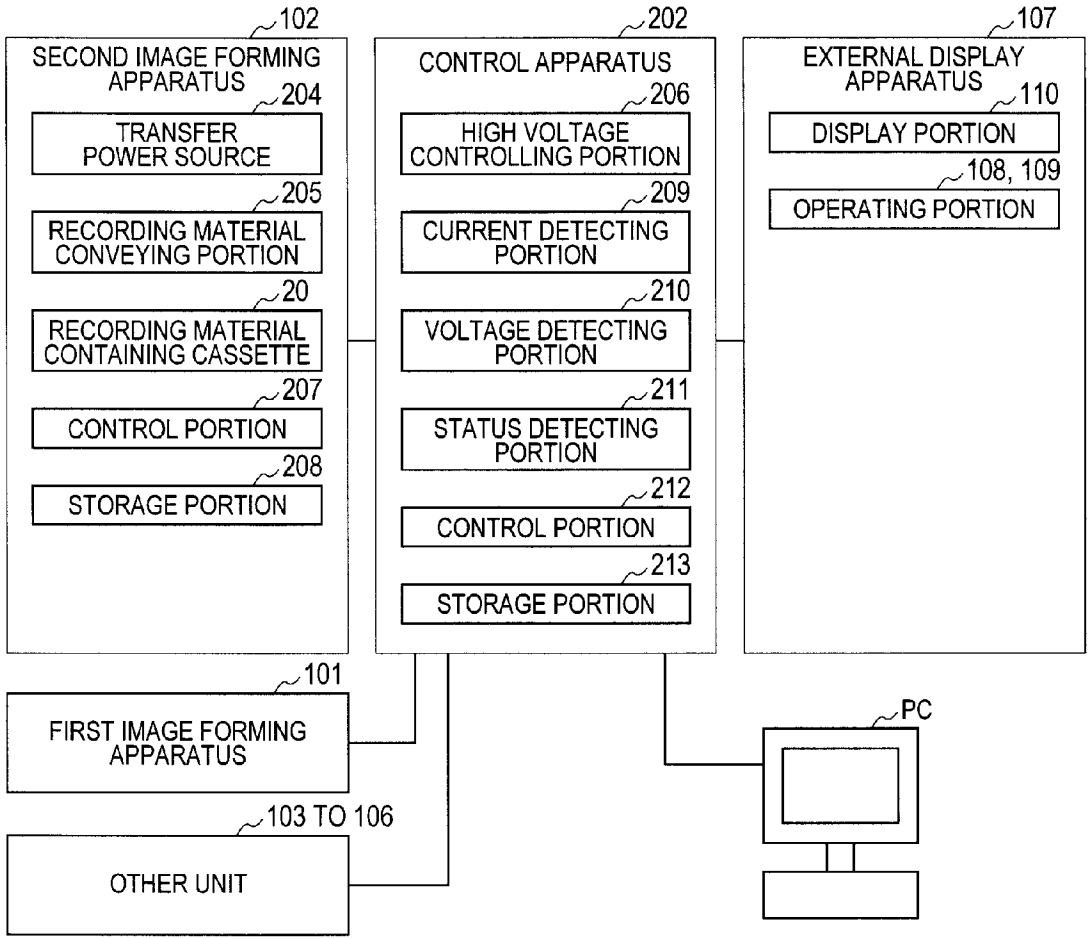
FIG. 5 is a block diagram illustrating a control system for the multiply-connecting image forming apparatus.
Figure 6A:
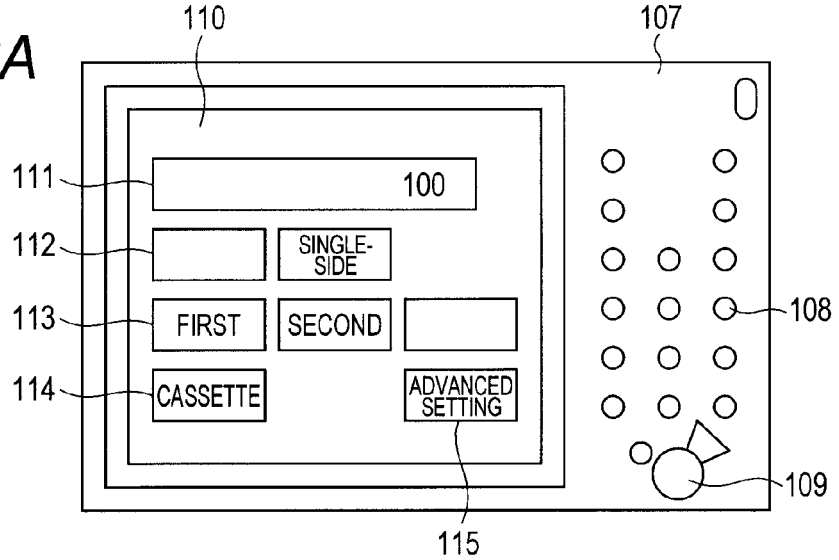
FIGS. 6A, 6B, and 6C are explanatory diagrams illustrating an operation screen of an external display apparatus.
Figure 6B:
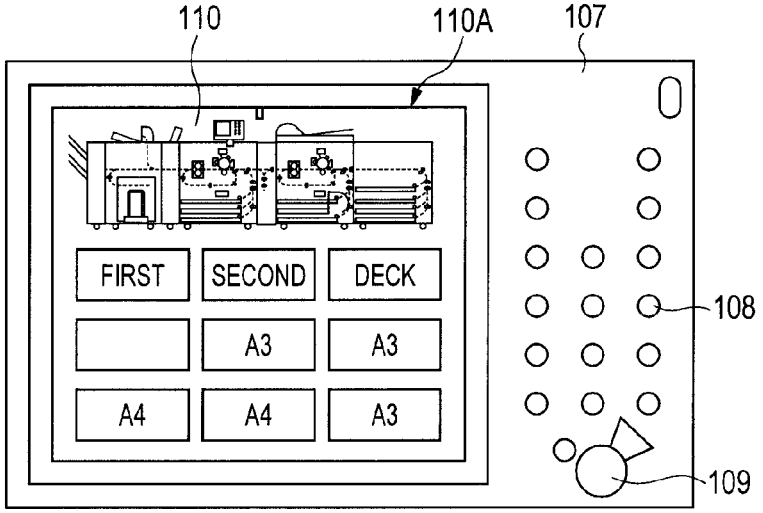
Figure 6C:
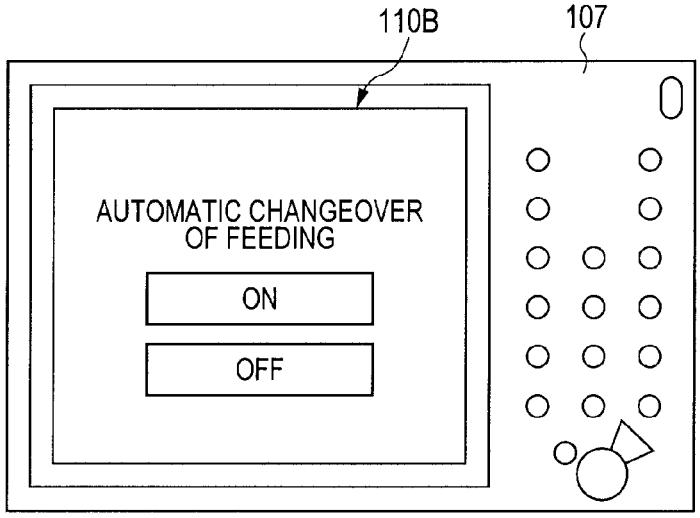

FIG. 5 is a block diagram illustrating a control system for the multiply-connecting image forming apparatus. FIGS. 6A, 6B, and 6C are explanatory diagrams illustrating an operation screen of the external display apparatus. In FIGS. 6A to 6C, FIG. 6A illustrates the external display apparatus, FIG. 6B illustrates a cassette setting screen 110A, and FIG. 6C illustrates an automatic feeding changeover setting screen 110B.

As illustrated in FIG. 5, the first and second image forming apparatus 101 and 102 each include a transfer power source 204, a recording material conveying portion 205, the recording material containing cassette 20, the control portion 207, and a storage portion 208. The control apparatus 202 includes a high voltage controlling portion 206, a current detecting portion 209, a voltage detecting portion 210, a status detecting portion 211, a control portion 212, and the storage portion 213.

Referring to FIG. 1, as illustrated in FIG. 5, the basic component units (101 to 106) of the multiply-connecting image forming system 100 are each connected to the control apparatus 202 through a predetermined input/output interface, and controlled in response to a command from the control apparatus 202. The control portion 207 inside the first image forming apparatus 101 (or the second image forming apparatus 102) is connected to the external display apparatus 107 via a circuit inside the control portion 212 of the control apparatus 202. The input/output interface corresponds to, for example, a connection jack of a local area network (LAN) cable, and is a point at which a print job is to be input from terminals, such as an external computer (PC) and a workstation, via a network.

As illustrated in FIG. 6A, the external display apparatus 107 is constructed of, for example, numerical key buttons 108 for inputting numerical values. A user and an operator directly operate the external display apparatus 107 to issue commands for the number of prints and a printing operation. The numerical key buttons 108 serve as buttons for inputting numerical values to designate the number of prints, and include a clear button "C" for canceling the input, and a reset button "R" for resetting all the settings. A start button 109 serves as a button for transmitting a printing start command. When the user or operator presses the start button 109, the control apparatus 202 reads the print settings on the number of prints, the cassette, and the like, which are set through the external display apparatus 107, and the printing operation is started.

A liquid crystal touch panel 110 is a liquid crystal monitor that employs a touch panel system, and is capable of information display and information input through panel touch. A displaying portion 111 displays the number of prints. A print setting button 112 serves as a button for setting whether to perform simplex printing or duplex printing for an image to be output. As an initial value, the duplex printing indicated in a highlighted manner is selected. When designating the simplex printing, a "single-side" button is touched so that the highlighted portion is changed. Accordingly, the simplex printing is designated.

An image formation setting button 113 illustrated in FIG. 6A serves as a button for designating the "first duplex image forming mode" or the "second duplex image forming mode". In the "first duplex image forming mode", the first image forming apparatus 101 and the second image forming apparatus 102 perform duplex printing in a divided manner. In the "second duplex image forming mode", only the second image forming apparatus 102 performs duplex printing. As an initial setting, the "first duplex image forming mode" is set. Control for each setting will be described later.

Note that, the print settings may be performed using the liquid crystal touch panel 110 of the external display apparatus 107, and alternatively, a print command may be issued using the external computer PC via an input interface. On a print setting screen displayed on a display of the external computer PC, a setting window for the above-mentioned setting items is displayed. Accordingly, it is possible to perform settings on whether the printing is performed by the first image forming apparatus 101 alone, by the second image forming apparatus 102 alone, or by both the image forming apparatus 101 and 102.

A cassette designation button 114 illustrated in FIG. 6A serves as a button for transition to a screen for designating a cassette to be used for printing. When the user or operator touches the cassette designation button 114, as illustrated in FIG. 6B, the cassette setting screen 110A is displayed. On the cassette setting screen 110A, options of currently available cassettes are displayed, and the user or operator may designate one of the cassettes.

An advanced setting button 115 serves as a button for transition to a screen for designating advanced print settings other than basic settings. When the user or operator touches the advanced setting button 115, as illustrated in FIG. 6C, the automatic feeding changeover setting screen 110B is displayed. Each time the user or operator presses the advanced setting button 115, setting screens for other setting conditions in a hierarchical structure are displayed sequentially. Through an appropriate operation screen, the user or operator can perform print scaling designation and various other settings.

(First Duplex Image Forming Mode)

Figure 7:
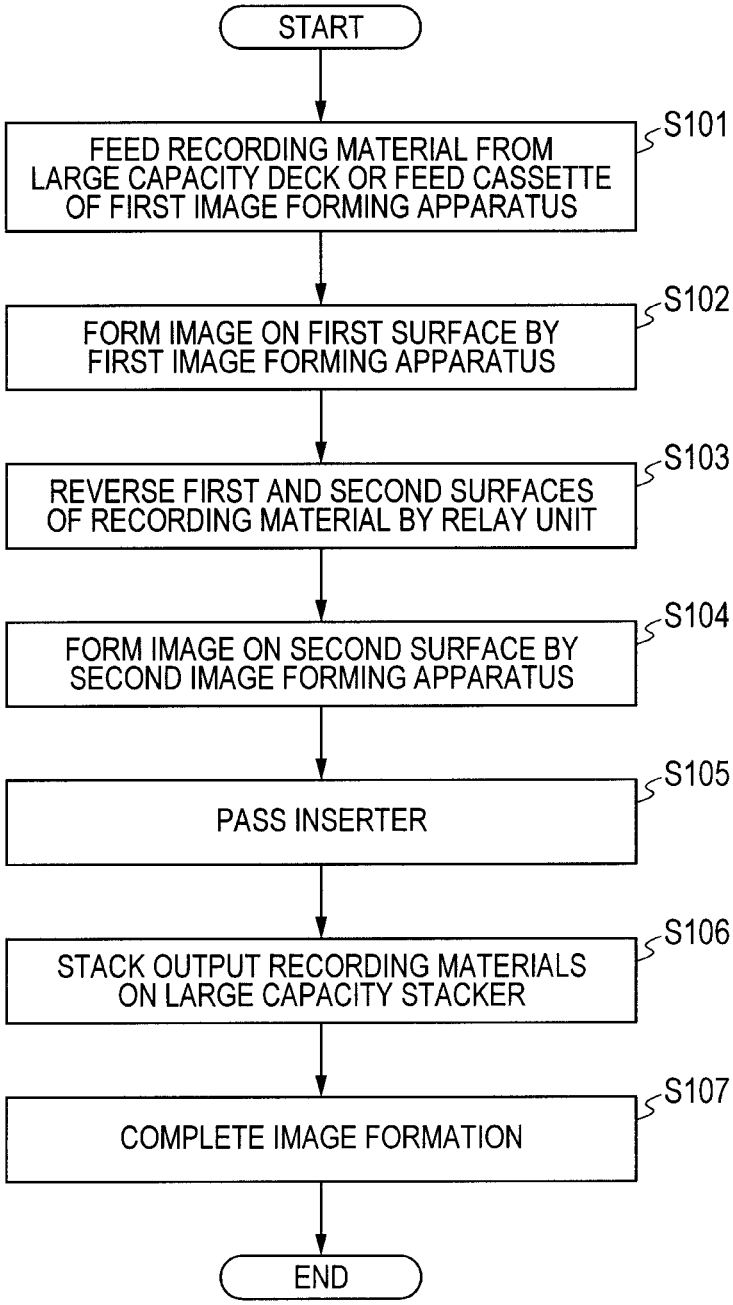
FIG. 7 is a flowchart illustrating control in a first duplex image forming mode.

FIG. 7 is a flowchart illustrating control in the first duplex image forming mode. As illustrated in FIG. 6A, when the user or operator presses the start button 109 "in a state in which the first duplex image forming mode is selected" through the image formation setting button 113, a duplex image forming mode executing unit executes image formation in the duplex printing mode in which the first image forming apparatus 101 and the second image forming apparatus 102 perform front surface printing and back surface printing, respectively, in a divided manner.

Referring to FIG. 1, as illustrated in FIG. 7, the control apparatus 202 allows feeding and conveyance of the recording material P stored in the large capacity deck 103 or the recording material cassette (first recording material containing portion) 20 of the first image forming apparatus 101 (S101). A toner image formed by the first toner image forming portion 101A is transferred onto the recording material P thus fed and conveyed, and the toner image is fixed onto the recording material P by the first fixing device 10A. In this manner, image formation on the first surface is performed (S102).

The control apparatus 202 causes the relay unit 104 to reverse the front surface and the back surface of the recording material P and convey the recording material P to the second image forming apparatus 102 (S103). A toner image formed by the second toner image forming portion 101B is transferred onto the back surface of the reversed recording material P, and the toner image is fixed onto the recording material P by the second fixing device 10B. In this manner, image formation on the second surface is performed (S104).

When outputting the printed matter by inserting several pages other than currently output pages into the printed matter, the control apparatus 202 activates the inserter 105 to insert an insertion page of, for example, a printed matter that is printed in advance at a predetermined location of a bundle of recording materials (S105).

Finally, the control apparatus 202 causes the recording material P to be stacked inside the large capacity stacker 106, and completes the printing. The large capacity stacker 106 stacks the output printed matters in the order of output. The output printed matters are stacked on a wagon so as to enable easy conveyance for post-processing steps such as trimming to be performed subsequently (S106). When the image formation does not remain after the current image forming operation is finished, the control apparatus 202 finishes the print job (S107).

(Second Duplex Image Forming Mode)

Figure 8:
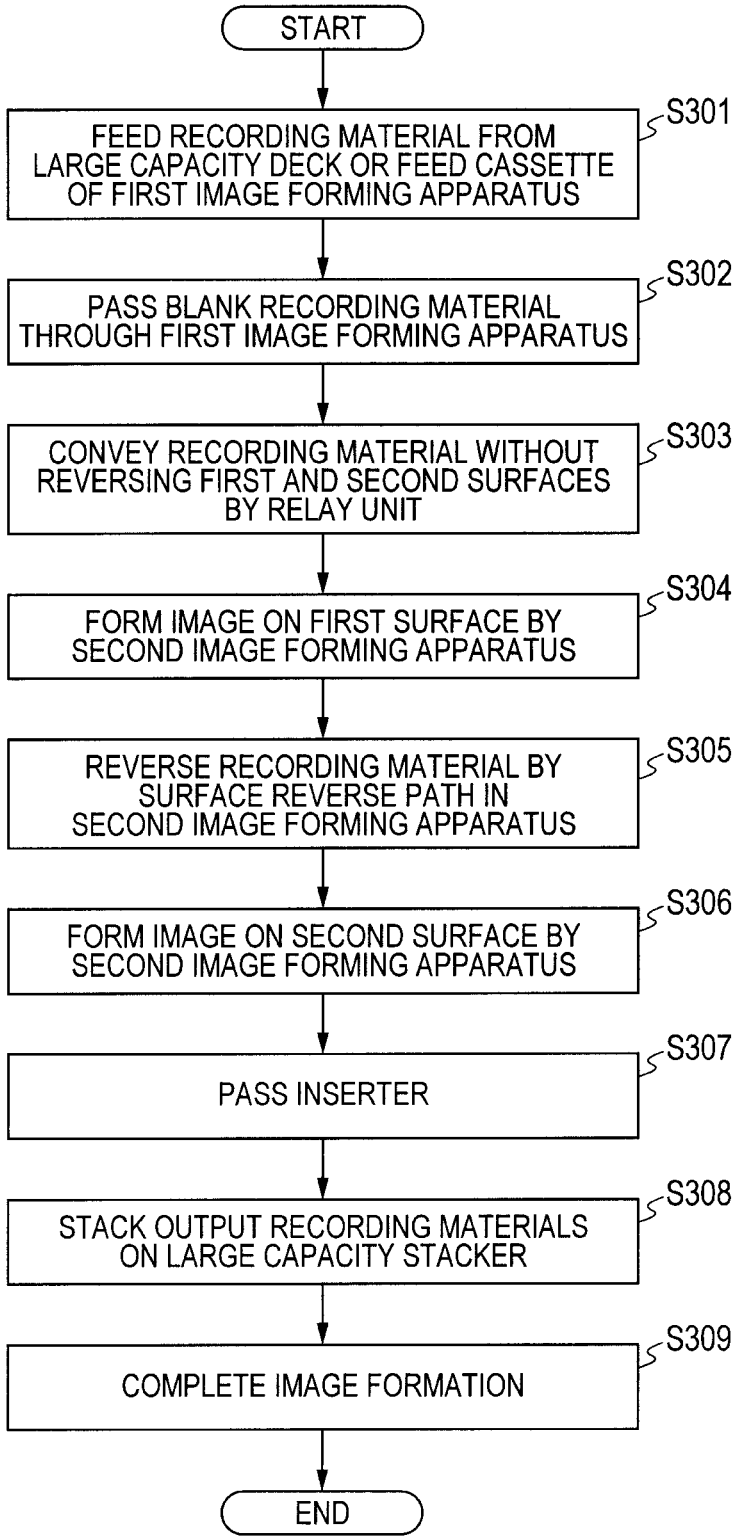
FIG. 8 is a flowchart illustrating control in a second duplex image forming mode.

FIG. 8 is a flowchart illustrating control in the second duplex image forming mode. As illustrated in FIG. 6A, when the user or operator presses the start button 109 "in a state in which the second duplex image forming mode is selected" through the image formation setting button 113, the duplex image forming mode executing unit executes image formation in the second duplex image forming mode in which only the second image forming apparatus 102 executes front surface printing and back surface printing.

Referring to FIG. 1, as illustrated in FIG. 8, the control apparatus 202 allows feeding and conveyance of the recording material P stored in the large capacity deck 103 or the recording material cassette (first recording material containing portion) 20 of the first image forming apparatus 101 (S301). The recording material P conveyed to the first image forming apparatus 101 is passed through the first image forming apparatus 101 without performing image formation (S302). At this time, the control apparatus 202 transmits an image signal of a blank image, and the first image forming apparatus 101 outputs a blank sheet.

The control apparatus 202 causes the relay unit 104 to directly convey the recording material P to the second image forming apparatus 102 without reversing the front surface and the back surface of the recording material P (S303). A toner image is transferred onto the recording material P conveyed to the second image forming apparatus 102, and the toner image is fixed onto the recording material P by the second fixing device 10B arranged inside the second image forming apparatus 102. In this manner, image formation on the first surface is performed (S304).

The control apparatus 202 causes the back surface printing conveyance path 34 inside the second image forming apparatus 102 to switch back the recording material P and reverse the front surface and the back surface of the recording material P, to thereby feed and convey the recording material P again to the secondary transfer portion T2 of the second image forming apparatus 102 (S305). A toner image is transferred again onto the reversed recording material P by the second image forming apparatus 102, and the toner image is fixed onto the recording material P by the second fixing device 10B arranged inside the second image forming apparatus 102. In this manner, image formation on the second surface is performed (S306).

The control apparatus 202 activates the inserter 105 as necessary to insert an insertion page at a predetermined location of a bundle of recording materials (S307). The control apparatus 202 causes the recording material P to be stacked inside the large capacity stacker 106 (S308), and finishes the print job when the image formation does not remain (S309).

By the way, in the multiply-connecting image forming system 100, all the printing operations are stopped merely when the first image forming apparatus 101 on the upstream side has run out of toner. The out-of-toner state herein refers to a state in which toner contained in a toner bottle or a hopper for replenishing toner in the development device is consumed completely. The above description is directed to the case where both the first image forming apparatus 101 and the second image forming apparatus 102 are available in the first duplex image forming mode, but the first image forming apparatus 101 may run out of toner during continuous image formation in the first duplex image forming mode. At this time, the first duplex image forming mode cannot be continued, and hence the image forming operations of both the first image forming apparatus 101 and the second image forming apparatus 102 are stopped.

In a case where the multiply-connecting system is constructed by connecting two image forming apparatus each including the reverse conveyance mechanism, the duplex printing can be continued by only the image forming apparatus which has not run out of toner. When the first image forming apparatus 101 is, for some reasons, brought into the state in which the image formation cannot be performed during the continuous image formation, the first duplex image forming mode is changed over to the second duplex image forming mode, and accordingly the continuous image formation can be continued though the productivity is lowered.

As illustrated in FIG. 6A, when the operator comes and operates the image formation setting button 113 to designate the second duplex image forming mode, the remaining continuous image formation job can be completed in the second duplex image forming mode. In the second duplex image forming mode, only the second image forming apparatus 102 performs duplex image formation, and hence the number of print outputs per unit time is halved as compared to the first duplex image forming mode, but designation to the second duplex image forming mode has an advantage that the printing operation can be continued.

However, the multiply-connecting image forming system is demanded in the field of job printing, which mainly requires high productivity, and hence the multiply-connecting image forming system is required to be capable of mass output and continuous operation. Further, there is a demand for such usage that the continuous operation is kept running for 24 hours and the operator is allowed to leave the office in the state in which the unattended operation is kept running until the next morning. In this case, when the toner is used up in the middle of the night, the multiply-connecting image forming system is stopped in the unattended state. In the case of the unattended operation on the night or in an installation environment in which the operator is not stationed full time, when the first image forming apparatus 101 has run out of toner and therefore cannot perform the image formation, the printing operation is entirely stopped over a long period of time until the next morning.

In order to resolve such trouble, in the multiply-connecting image forming system 100, a control unit switches control so that, when the first image forming apparatus 101 has run out of toner, the second image forming apparatus 102 in the normal state continues the printing operation. When the first image forming apparatus 101 has run out of toner during execution of the first duplex image forming mode, the control unit automatically changes over the first duplex image forming mode to the second duplex image forming mode, to thereby continue the continuous image formation.

However, when the duplex printing performed by two image forming apparatus in a divided manner is changed over to the duplex printing performed by a single image forming apparatus, the image density turns out to change significantly before and after the changeover so that the quality of the output image is lowered. In the image formation using the fixing device, the amount of water contained in the recording material is reduced when the recording material passes through the fixing device. In a case of using the single second image forming apparatus 102, the recording material passes through the fixing device 10B one time in the simplex printing mode, and two times in the duplex printing mode. Further, the temperature of the fixing device 10B is controlled at an appropriate temperature during image formation, and hence the transfer voltages for the first surface and the second surface only need to be set in accordance with the temperature and humidity in the surrounding environment (absolute amount of water) and the type of the recording material.

However, in the multiply-connecting image forming system 100, in a case where the recording material is fed and conveyed from the large capacity deck 103 (or the first image forming apparatus 101) to perform duplex printing by the second image forming apparatus 102, the recording material has already passed through the fixing device 10A of the first image forming apparatus 101. In this case, the transfer voltage for the first surface to be applied in the second image forming apparatus 102 needs to be set using the transfer voltage for the second surface. Further, the transfer voltage for the second surface to be applied at the time of duplex printing needs to be set to a voltage value adapted to the recording material that has already passed through the fixing devices 10A and 10B two times. This voltage has a voltage value that is not set in the case of using the single second image forming apparatus 102, and hence this setting is unique to the multiply-connecting image forming system 100.

In view of the above, in the following embodiments, when the first duplex image forming mode is automatically changed over to the second duplex image forming mode, the recording material sharing voltage Vp is set larger by an amount corresponding to an increase in resistance value resulting from one-time passage through the fixing device 10A at the time when the toner image is transferred onto the first surface of the recording material.

First Embodiment

Figure 9:
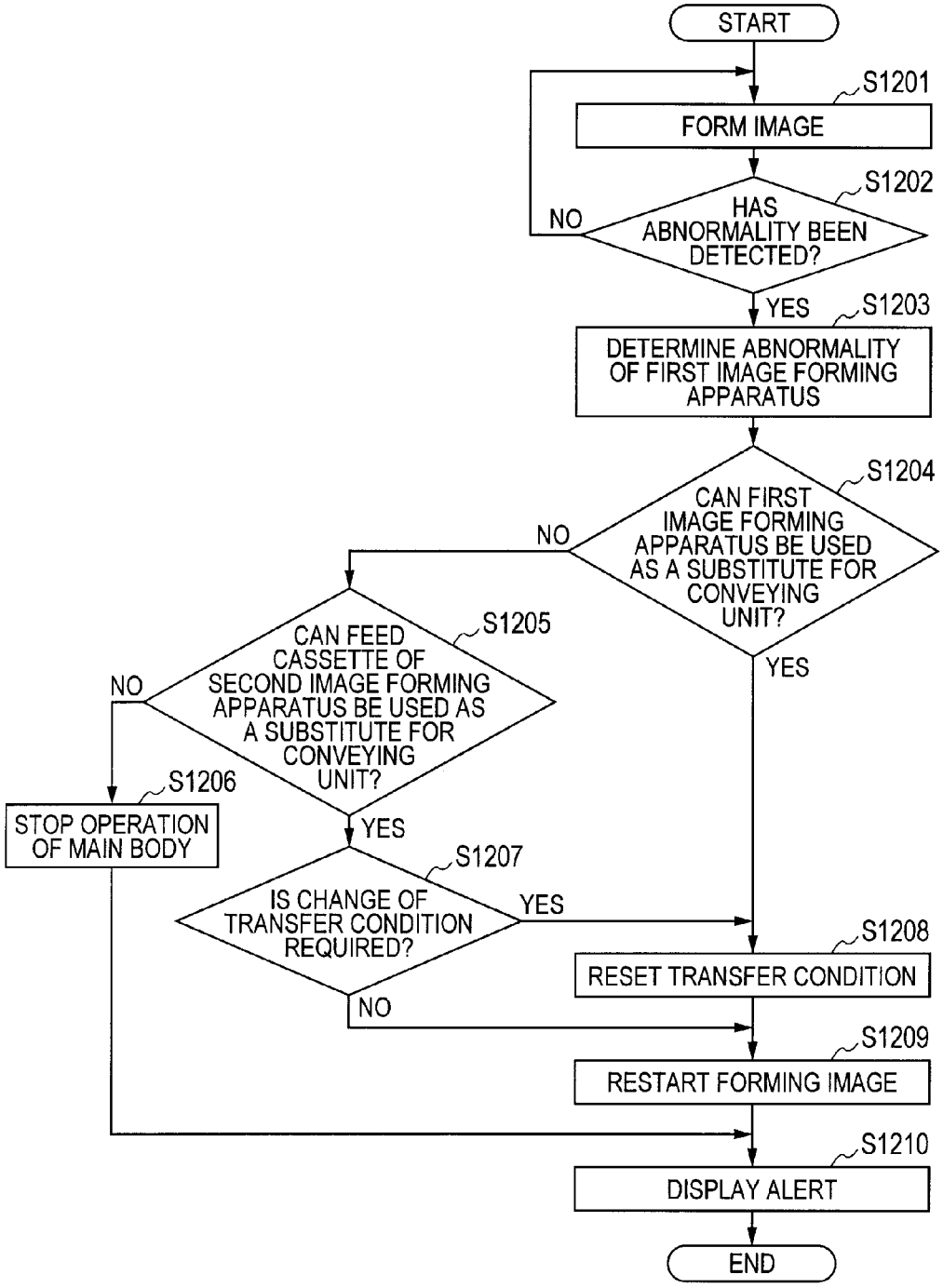
FIG. 9 is a flowchart illustrating control for automatic changeover to the second duplex image forming mode according to a first embodiment of the present invention.
Figure 10:
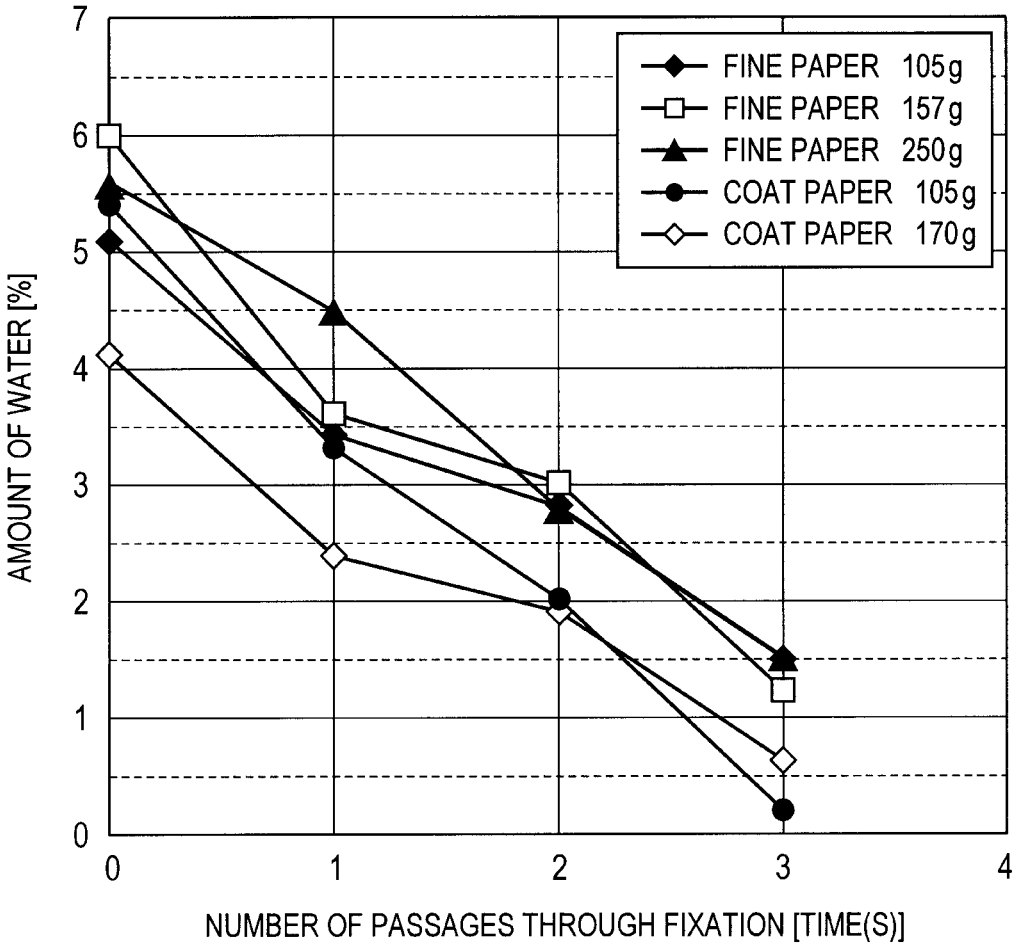
FIG. 10 is an explanatory graph showing a relationship between the number of passages through a fixing device and an amount of water contained in a recording material.
Figure 11:
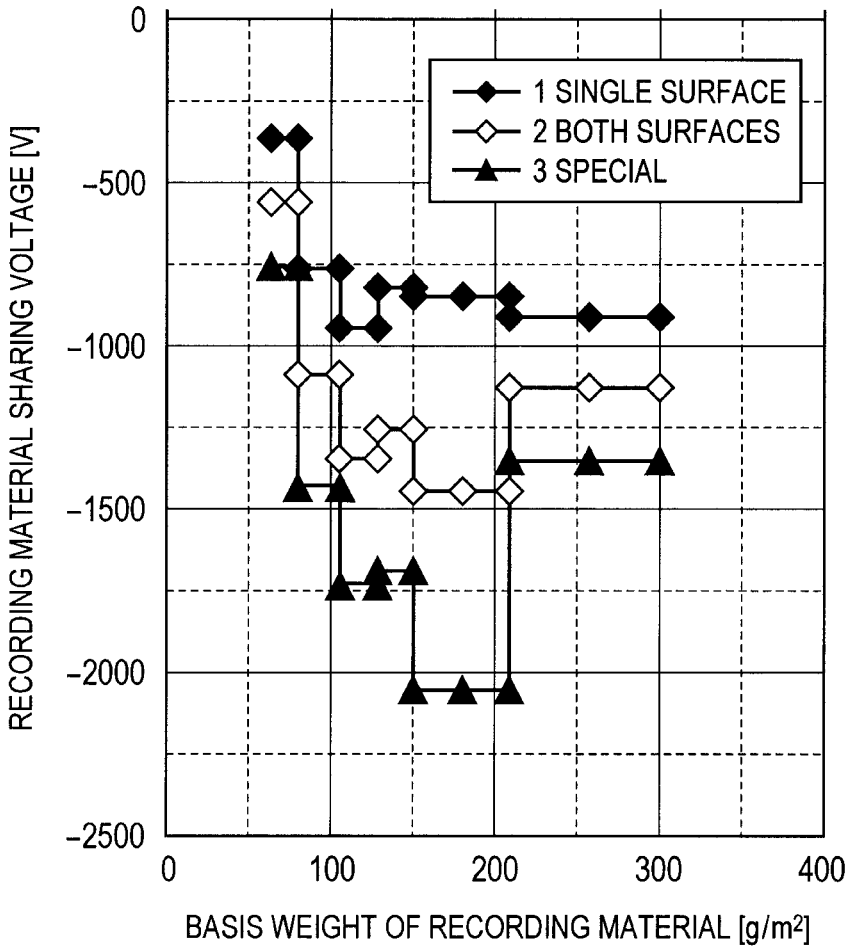
FIG. 11 is an explanatory graph showing settings on a recording material sharing voltage to be performed in accordance with the type of the recording material.
Figure 12:
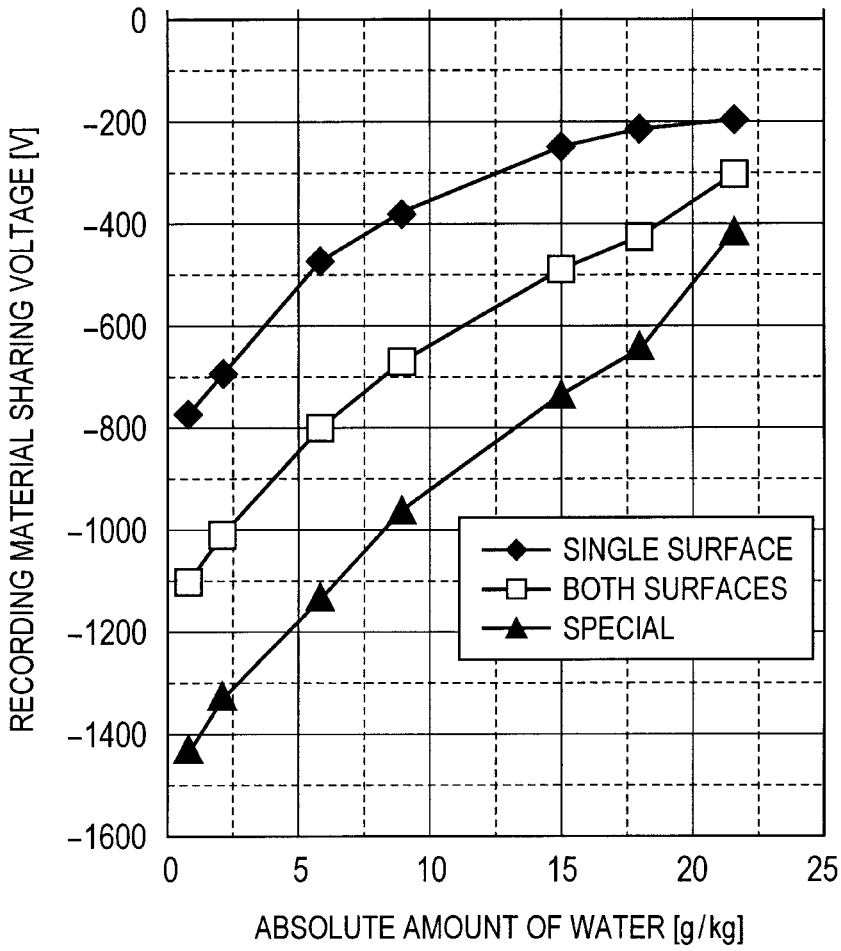
FIG. 12 is an explanatory graph showing settings on the recording material sharing voltage to be performed in accordance with an absolute amount of water in the surrounding environment.

FIG. 9 is a flowchart illustrating control for automatic changeover to the second duplex image forming mode according to a first embodiment of the present invention. FIG. 10 is an explanatory graph showing a relationship between the number of passages through the fixing device and the amount of water contained in the recording material. FIG. 11 is an explanatory graph showing settings on the recording material sharing voltage to be performed in accordance with the type of the recording material. FIG. 12 is an explanatory graph showing settings on the recording material sharing voltage to be performed in accordance with the absolute amount of water in the surrounding environment.

As illustrated in FIG. 1, when abnormality occurs in the toner image forming portion 101A in a period in which an image is formed by the second image forming apparatus 102 on the recording material having an image formed thereon by the first image forming apparatus 101, a determining unit of the control apparatus 202 performs determination to stop the formation of the toner image by the toner image forming portion 101A. When abnormality occurs in the toner image forming portion 101A in a period in which the duplex printing is executed by the first image forming apparatus 101 and the second image forming apparatus 102 in a divided manner, the determining unit performs determination to change over the current duplex printing to the duplex printing to be performed by only the second image forming apparatus 102 using the back surface printing conveyance path 34. The control apparatus 202 as an example of the control unit causes the second image forming apparatus 102 to form images on both surfaces of the recording material that has been fed and conveyed from the large capacity deck 103 and at least passed through the fixing device 10A.

Through the control of the first embodiment, even when abnormality occurs in the first image forming apparatus 101 for some reasons so that the image formation cannot be performed, the remaining continuous image formation can be maintained though the productivity is halved.

When the recording material passes through the fixing devices 10A and 10B, the amount of contained water is reduced and the resistance value increases. Therefore, as the number of passages of the recording material through the fixing devices 10A and 10B becomes larger, there occurs an increase in recording material sharing voltage Vp required for the flow of the current having the desired current value It through the secondary transfer portion T2 at the time of image formation. Accordingly, the transfer power source 204 needs to increase the voltage value Vtr of the voltage to be output to the secondary transfer roller 24 at the time of image formation.

Table 1 shows a list of the units for feeding and conveying the recording material, the printing modes, and the recording material sharing voltages to be applied to the secondary transfer portion T2 of each of the first image forming apparatus 101 and the second image forming apparatus 102.

TABLE 1

| Printing mode | Site of abnormality | Feeding unit | Image formation | Second image forming apparatus Transfer voltage |
|---|---|---|---|---|
| Simplex | First image forming apparatus | First image forming apparatus | First image forming apparatus | Tb |
| Simplex | First image forming apparatus | Large capacity deck | First image forming apparatus | Tb |
| Simplex | First image forming apparatus | Second image forming apparatus | Second image forming apparatus | Tb |
| Simplex | First image forming apparatus | Large capacity deck | Second image forming apparatus | Tb |
| Duplex | First image forming apparatus | First image forming apparatus | First and second image forming apparatus | First surface: Tb, second surface: Tc |
| Duplex | First image forming apparatus | Large capacity deck | First and second image forming apparatus | First surface: Tb, second surface: Tc |
| Duplex | First image forming apparatus | Second image forming apparatus | First and second image forming apparatus | First surface: Ta, second surface: Tb |

As shown in Table 1, as the number of passages of the recording material through any one of the fixing devices 10A and 10B increases in the order of zero, one, and two, the recording material sharing voltage is set larger so that Ta<Tb<Tc holds.

That is, in the image formation on the first surface to be performed in the first duplex image forming mode, the first toner image forming portion 101A transfers a toner image onto a moist recording material which has not passed through the fixing device 10A. Then, in the image formation on the second surface, the second toner image forming portion 101B transfers a toner image onto the recording material which has passed through the fixing device 10A one time. Therefore, the recording material sharing voltage Vp is set larger by an amount corresponding to an increase in resistance value resulting from one-time passage through the fixing device 10A in the image formation on the second surface.

On the other hand, in the image formation on the first surface to be performed in the second duplex image forming mode, the second toner image forming portion 101B transfers a toner image onto the recording material which has passed through the fixing device 10A and has therefore been dried to a given degree. Therefore, the control apparatus (control unit) 202 sets the recording material sharing voltage Vp larger by an amount corresponding to an increase in resistance value resulting from one-time passage through the fixing device 10A.

Further, in the image formation on the second surface to be performed in the second duplex image forming mode, the second toner image forming portion 101B transfers a toner image onto the recording material which has passed through the fixing device 10B subsequently to the fixing device 10A and has therefore been dried to a higher degree. Therefore, the recording material sharing voltage Vp is set larger by an amount corresponding to an increase in resistance value resulting from two-time passage through the fixing devices 10A and 10B, that is, the recording material sharing voltage Vp is set still larger than in the case of the image formation on the first surface.

Referring to FIG. 1, as illustrated in FIG. 9, the control apparatus 202 recognizes that the printing operation in the first duplex image forming mode is being executed by the first image forming apparatus 101 and the second image forming apparatus 102 (S1201). At this time, as illustrated in FIG. 5, the status detecting portion 211 stands by to receive an abnormality occurrence signal to be transmitted from the first image forming apparatus 101 and the second image forming apparatus 102. The abnormality refers to a failure in various output voltages, an out-of-toner state, a jam of the recording material, and the like.

When the status detecting portion (determining unit) 211 determines that there is no abnormality ("NO" in S1202), the control apparatus 202 maintains the image forming operation (S1201). On the other hand, when the status detecting portion (determining unit) 211 determines that abnormality has occurred in the first image forming apparatus 101 ("YES" in S1202), the control apparatus 202 confirms the occurrence of the abnormality through diagnosis of the site of abnormality (S1203). Then, the control apparatus 202 determines whether or not the first image forming apparatus 101 in the state in which the image formation cannot be performed can be used as a substitute for a conveying unit for conveying the recording material (S1204). The abnormality in which the first image forming apparatus 101 can be used as a substitute for the conveying unit corresponds to the out-of-toner state (stop of toner replenishment) of the development devices 4*a*, 4*b*, 4*c*, and 4*d* illustrated in FIG. 2, the failure in voltages to be applied to the charging rollers 2*a*, 2*b*, 2*c*, and 2*d*, and the like. In this type of abnormality, the recording material can be conveyed but the image formation cannot be continued.

When the first image forming apparatus 101 can be used as a substitute for the feed source of the recording material ("YES" in S1204), the control apparatus 202 changes the recording material sharing voltage Vp to reset the voltage value Vtr of the voltage to be applied to the secondary transfer roller (second transfer unit) 24 at the time of image formation (S1208). As described above, the value of the recording material sharing voltage Vp in accordance with the number of fixations is added to the voltage value Vt in the state in which no recording material is present, which is determined through the ATVC, and accordingly the voltage value Vtr of the voltage to be applied to the secondary transfer roller (second transfer unit) 24 at the time of image formation is determined. Then, similarly to the above, the recording material is fed and conveyed from the large capacity deck 103 (or the recording material cassette 20 of the first image forming apparatus 101) to restart the image formation in the second duplex image forming mode (S1209).

(Third Duplex Image Forming Mode)

When the first image forming apparatus 101 cannot be used as a substitute for the conveying unit for conveying the recording material ("NO" in S1204), the control apparatus 202 determines whether or not the recording material cassette 20 built into the second image forming apparatus 102 can be used as a substitute for the conveying unit for conveying the recording material (S1205). When the recording material cassette 20 built into the second image forming apparatus 102 cannot feed and convey the recording material of the same type, the control apparatus 202 determines that the recording material cassette 20 built into the second image forming apparatus 102 cannot be used as a substitute for the conveying unit for conveying the recording material ("NO" in S1205), and stops the operation of the main body (S1206). On the other hand, when the recording material cassette (second recording material containing portion) 20 of the second image forming apparatus 102 can feed and convey the recording material of the same type, the control apparatus 202 determines that the recording material cassette 20 built into the second image forming apparatus 102 can be used as a substitute for the conveying unit for conveying the recording material ("YES" in S1205), and determines whether or not the voltage value Vtr of the voltage to be applied to the secondary transfer roller 24 at the time of image formation is required to be changed (S1207). When the control apparatus 202 determines that the voltage value Vtr is required to be changed ("YES" in S1207), the control apparatus 202 changes the recording material sharing voltage Vp so that the number of fixations is decremented by one, to thereby reset the voltage value Vtr of the voltage to be applied to the secondary transfer roller 24 at the time of image formation (S1208). Then, the large capacity deck 103 or the recording material cassette 20 of the first image forming apparatus 101 is changed over to the recording material cassette (second recording material containing portion) 20 built into the second image forming apparatus 102 to feed and convey the recording material so that image formation in a third duplex image forming mode is performed (S1209).

The abnormality has occurred in the first image forming apparatus 101, and hence the control apparatus 202 displays an alert on the external display apparatus 107 (S1210).

In this case, it is assumed that the large capacity deck 103 is set as the feeding unit, that the first image forming apparatus 101 is held in an operable state, that the temperature of the fixing device 10A is controlled at a specified temperature, and that the control for automatic changeover to the second duplex image forming mode is performed during the control in the first duplex image forming mode. In the second duplex image forming mode, the first image forming apparatus 101 does not perform the image formation. Therefore, the first image forming apparatus 101 performs the printing operation for a blank image to convey the recording material to the second image forming apparatus 102, and the second image forming apparatus 102 performs the image formation on the first surface. At this time, the recording material before the image formation passes through the fixing device 10A of the first image forming apparatus 101 one time so that the recording material is heated.

When the second image forming apparatus 102 performs the image formation on the first surface, the image formation is performed virtually on the first surface, but in view of the amount of water contained in the recording material, the transfer voltage condition at the time of the second surface needs to be applied. Further, when the image is fixed onto the second surface, in view of the amount of water contained in the recording material, the transfer voltage corresponding to the amount of water contained in the recording material after two-time fixation needs to be set.

As shown in FIG. 10, a study was conducted on a relationship between the number of fixations and the amount of contained water for several types of recording material left in an environment in which the temperature was 23° C. and the humidity was 50%. It was found that, as the number of fixations increased, the amount of water contained in the recording material was reduced due to evaporation of water by heating, and the linearity was not deteriorated even when the third fixation was performed in addition to the normal operation in which the fixation was performed two times.

As described above, it is understood that the optimal recording material sharing voltage Vp changes along with the reduction in amount of water contained in the recording material. The recording material sharing voltage is subjected to linear interpolation based on the change in amount of water contained in the recording material for which the fixation is performed three times, with the result that the optimal recording material sharing voltage Vp can be set for each number of fixations. In the first embodiment, in accordance with the relationship described above, the optimal recording material sharing voltage Vp is set based on the basis weight of the recording material designated at the time of image formation.

As shown in FIG. 11, a study was conducted on a relationship between the basis weight and the optimal recording material sharing voltage Vp for multiple types of recording material left in the environment in which the temperature was 23° C. and the humidity was 50%. For each type of recording material, the optimal recording material sharing voltages Vp at the time of the first surface, the second surface, and the third surface are stored in the storage portion 213 inside the control apparatus 202.

As shown in FIG. 12, a study was conducted on the optimal recording material sharing voltage Vp for A3 plain paper at various temperatures and humidities (absolute amounts of water). For each temperature and humidity, the optimal recording material sharing voltages Vp at the time of the first surface, the second surface, and the third surface are stored in the storage portion 213 inside the control apparatus 202.

Based on the graph of FIG. 11 and the graph of FIG. 12, the control portion 212 creates a table of the recording material sharing voltage Vp in accordance with the basis weight of the recording material, the type of paper, and the temperature and humidity, and stores the table in the storage portion 213 inside the control apparatus 202. Based on the recording material sharing voltage Vp determined from the table and the voltage value Vt determined through the ATVC, the control portion 212 calculates the voltage value Vtr of the transfer voltage to be applied to the secondary transfer roller 24 at the time of image formation.

$$Vtr=Vt+Vp \quad \text{(Expression 4)}$$

As described above, in the first embodiment, after the stop of the formation of the toner image by the toner image forming portion 101A, the toner image forming portion 101B transfers the toner image onto the recording material using a voltage that is larger in absolute value than the voltage before the stop of the formation of the toner image by the toner image forming portion 101A. After the stop of the formation of the toner image by the toner image forming portion 101A, the toner image forming portion 101A is operated under the condition for forming the blank toner image.

Further, after the stop of the formation of the toner image by the toner image forming portion 101A, the second image forming apparatus 102 causes the toner image forming portion 101B to transfer the toner image onto the recording material two times. The toner image forming portion 101B transfers the second toner image onto the recording material using a voltage that is higher than the voltage at the time of transferring the first toner image onto the recording material. After the stop of the formation of the toner image by the toner image forming portion 101A, the toner image forming portion 101B transfers the toner image onto the recording material using a voltage that is larger in absolute value than the voltage in the case where the recording material is fed and conveyed from the recording material cassette 20 of the second image forming apparatus 102.

Accordingly, even when the amount of water contained in the recording material changes, the efficiency of transfer of the toner image at the secondary transfer portion T2 is maintained at the maximum peak, and the density change of the output image before and after the changeover is prevented.

Second Embodiment

Figure 13:
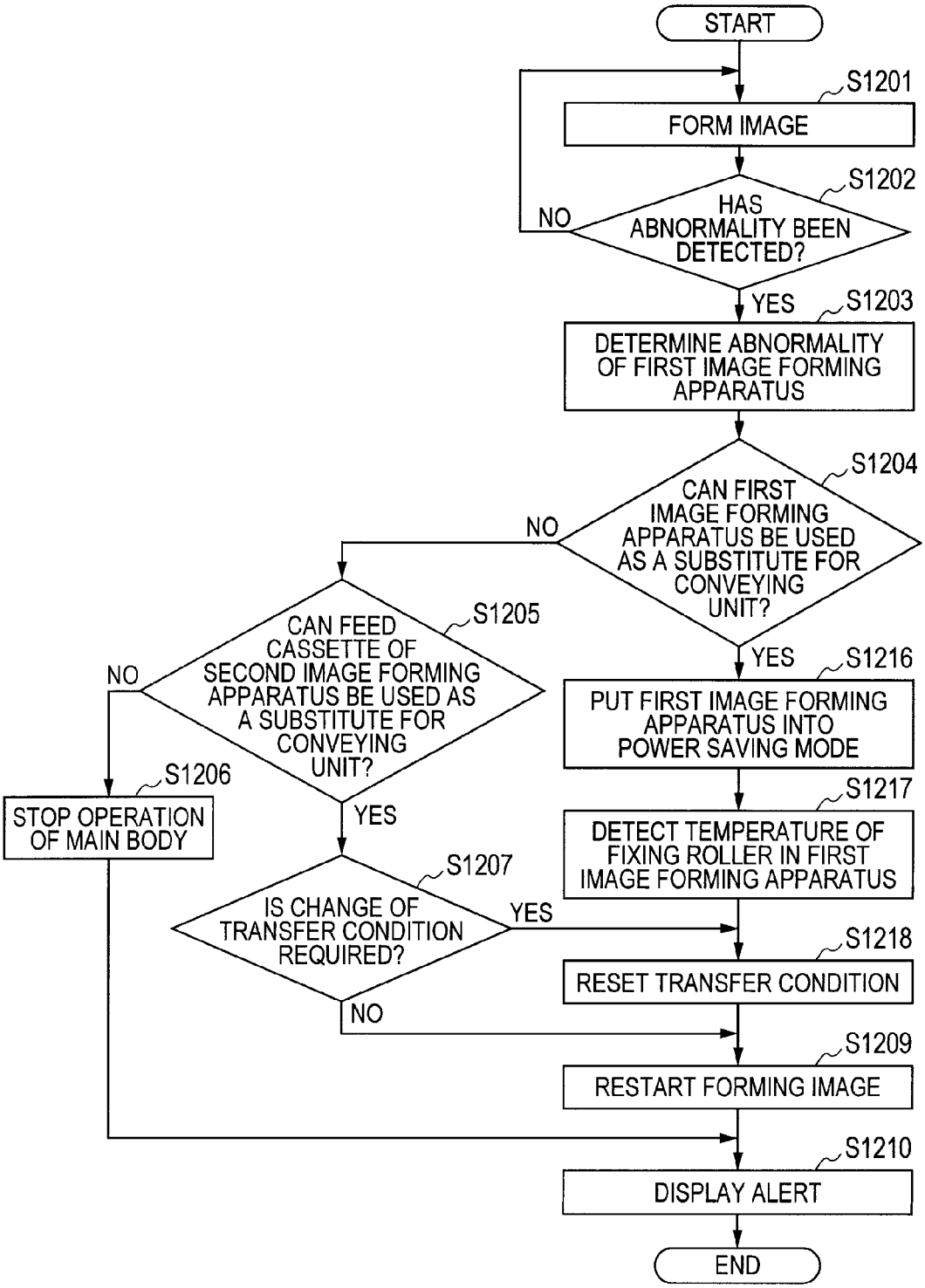
FIG. 13 is a flowchart illustrating control for automatic changeover to the second duplex image forming mode according to a second embodiment of the present invention.
Figure 14:
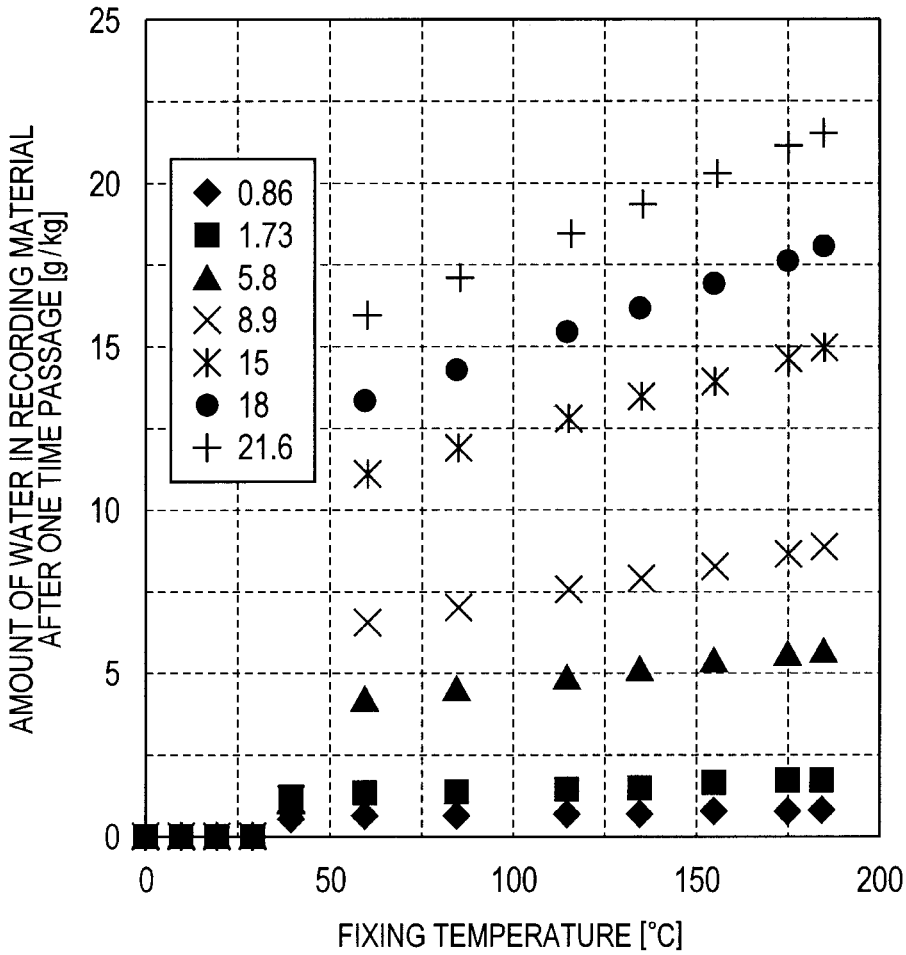
FIG. 14 is an explanatory graph showing a relationship between a temperature state of the fixing device and the amount of water contained in the recording material.

FIG. 13 is a flowchart illustrating control for automatic changeover to the second duplex image forming mode according to a second embodiment of the present invention. FIG. 14 is an explanatory graph showing a relationship between the temperature of the fixing roller and the amount of reduction in amount of water contained in the recording material.

In the first embodiment, the description is directed to the control to be performed in the state in which the fixing device 10A of the first image forming apparatus 101 is controlled at the specified temperature. The temperature of the fixing roller of the first image forming apparatus 101 is controlled at the specified temperature, and hence the amount of water contained in the recording material that is heated when passing through the fixing device 10A exhibits a constant value. However, when the first image forming apparatus 101 transitions to a power saving mode, the temperature state of the fixing device 10A varies. Under the condition in which the temperature state varies, as illustrated in FIG. 14, the amount of reduction in amount of water contained in the recording material changes even when the recording material passes through the same fixing device 10A. Under the condition in which the amount of reduction in amount of water contained in the recording material changes, the settings on the optimal transfer voltage for the second image forming apparatus 102 are further complicated.

In the second embodiment, after the stop of the formation of the toner image by the toner image forming portion 101A, the first image forming apparatus 101 transitions to the power saving mode to gradually decrease the temperature of the fixing device 10A. Therefore, after the stop of the formation of the toner image by the toner image forming portion 101A, the second toner image forming portion 101B gradually reduces the absolute value of the voltage for transferring the toner image onto the recording material.

That is, in the multiply-connecting image forming system 100, the transfer condition is changed based on results of measuring the temperature of the fixing roller of the fixing device 10A inside the first image forming apparatus 101. Because the fixing temperature becomes variable, the temperature is detected in real time, and the transfer voltage is changed based on the detection, with the result that the transfer voltage can be set more appropriately.

Referring to FIG. 1, as illustrated in FIG. 13, the control apparatus 202 recognizes that the printing operation in the first duplex image forming mode is being executed (S1201). When the control apparatus 202 determines that there is no abnormality in the first image forming apparatus 101 ("NO" in S1202), the control apparatus 202 continues the continuous image formation in the first duplex image forming mode (S1201). On the other hand, when the control apparatus 202 determines that abnormality has occurred in the first image forming apparatus 101 ("YES" in S1202), the control apparatus 202 confirms the occurrence of the abnormality (S1203), and determines whether or not the first image forming apparatus 101 can be used as a substitute for the conveying unit for conveying the recording material (S1204).

When the first image forming apparatus 101 can be used as a substitute for the conveying unit for conveying the recording material ("YES" in S1204), the control apparatus 202 stops the power feeding to the fixing device 10A of the first image forming apparatus 101 (S1216). Then, the temperature of the fixing roller of the fixing device 10A is read (S1217).

The control apparatus 202 changes the recording material sharing voltage Vp in accordance with the temperature of the fixing roller, to thereby reset the voltage value Vtr of the voltage to be applied to the secondary transfer roller 24 at the time of image formation (S1218).

As illustrated in FIG. 2, the thermistor 11*s* as an example of the temperature detecting unit detects the surface temperature of the fixing roller 11 at every moment, and the control portion 207 determines the recording material sharing voltage Vp based on the output from the thermistor 11*s* and the temperature and humidity in the surrounding environment, and with reference to the graph of FIG. 14. The value of the recording material sharing voltage Vp in accordance with the temperature of the fixing roller is added to the voltage value Vt in the state in which no recording material is present, which is determined through the ATVC, and accordingly the voltage values Vtr of the voltages to be applied to the secondary transfer roller 24 at the time of image formation on the first surface and the second surface are determined, respectively.

Then, the recording material is fed and conveyed from the large capacity deck 103 (or the recording material cassette 20 of the first image forming apparatus 101) to restart the image formation in the second duplex image forming mode (S1209).

When the large capacity deck 103 cannot feed the recording material of the same type ("NO" in S1204), the control apparatus 202 determines whether or not the recording material cassette 20 of the second image forming apparatus 102 can feed the recording material of the same type (S1205). When the recording material cassette 20 of the second image forming apparatus 102 cannot feed and convey the recording material ("NO" in S1205), the control apparatus 202 stops the operation of the main body (S1206).

On the other hand, when the recording material cassette 20 of the second image forming apparatus 102 can feed and convey the recording material of the same type ("YES" in S1205), the control apparatus 202 determines whether or not the voltage value Vtr of the voltage to be applied to the secondary transfer roller 24 at the time of image formation is required to be changed (S1207). When the control apparatus 202 determines that the voltage value Vtr is required to be changed ("YES" in S1207), the control apparatus 202 decrements the number of fixations by one, and changes the recording material sharing voltage Vp to the recording material sharing voltage Vp reflecting the temperature of the fixing roller detected at every moment, to thereby reset the voltage value Vtr of the voltage to be applied to the secondary transfer roller 24 at the time of image formation (S1218).

Then, the control apparatus 202 causes the recording material cassette 20 of the second image forming apparatus 102 to feed and convey the recording material so that the image formation in the second duplex image forming mode is restarted (S1209). The abnormality has occurred in the first image forming apparatus 101, and hence the control apparatus 202 displays an alert on the external display apparatus 107 (S1210).

When the abnormality has occurred and therefore the first toner image forming portion 101A stops performing the image formation, in order to suppress unnecessary power consumption, the first image forming apparatus 101 transitions to the power saving mode to set the temperature of the fixing device 10A to a lower value. Alternatively, the heater power source of the fixing device 10A is turned OFF.

In this case, the fixing device 10A starts to transition from the state of the specified temperature to a state of a temperature set in accordance with the power saving mode. After the stop of the formation of the toner image by the toner image forming portion 101A, the fixing device 10A gradually decreases its temperature. After the stop of the formation of the toner image by the toner image forming portion 101A, the second toner image forming portion 101B gradually reduces the absolute value of the voltage for transferring the toner image onto the recording material.

Even during the change in temperature, the conveyance path of the first image forming apparatus 101 and the second image forming apparatus 102 may serve to perform the image formation, and hence the image formation in duplex printing is continuously executed. In this period, the recording material passes through the fixing device 10A in various temperature states, and hence the amount of water contained in the recording material in the respective temperature states changes variously.

In this state, when the same transfer voltage is used for the image formation as in the first embodiment, a transfer failure is likely to occur. To address this problem, in the second embodiment, the control apparatus 202 grasps the change in amount of water contained in the recording material based on each temperature state of the fixing device 10A, to thereby correct the recording material sharing voltage Vp. The control portion 212 creates a table of the recording material sharing voltage Vp after one-time fixation in accordance with the temperature state of the fixing device 10A, and stores the table in the storage portion 213 inside the control apparatus 202. Based on the recording material sharing voltage Vp determined from the table and the voltage value Vt determined through the ATVC, the control portion 212 calculates the voltage value Vtr of the transfer voltage to be applied to the secondary transfer roller 24 at the time of image formation.

As shown in FIG. 14, a study was conducted on the amount of reduction in amount of water contained in the recording material after one-time fixation for A3 plain paper at various temperatures and humidities (absolute amounts of water) under the condition in which the temperature settings for the fixing device 10A were varied. With the X axis defined as representing a temperature setting value of the fixing devices 10A and 10B, for each absolute amount of water, FIG. 14 shows the amount of reduction in amount of water contained in the recording material after one-time fixation. The amount of water contained in the recording material after one-time fixation depends on the temperature state of the fixing device 10A and the temperature and humidity in the surrounding environment (absolute amount of water).

Based on the relationship shown in FIG. 14 as well as those in FIGS. 11 and 12, the optimal recording material sharing voltage Vp is calculated for the recording material after one-time fixation at various temperatures and humidities (absolute amounts of water). The relationships shown in FIGS. 11, 12, and 14 are stored in the storage portion 213 inside the control apparatus 202. In the second embodiment, the basic transfer voltage is set based on the relationships shown in FIGS. 11 and 12 in accordance with the status of the first image forming apparatus 101, and is used in the image formation. Under the condition in which the transfer voltage is set based on the relationship shown in FIG. 14, the transfer voltage is set by correcting the basic transfer voltage stored in the storage portion 213.

When the second embodiment is applied, in the multiply-connecting image forming system 100, the transfer condition is optimally set so that the image quality can be maintained and the image formation in the second duplex image forming mode can be started promptly without waiting for the decrease in temperature of the fixing device 10A in the continuous image formation. Continuous running of the continuous image forming processing can be maintained. Through the control involving the changing of the transfer voltage based on the temperature of the fixing roller of each of the fixing devices 10A and 10B, it is possible to provide an image forming system capable of preventing the transfer failure, suppressing the change in image density, and maintaining the productivity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-105841, filed May 11, 2011, which is hereby incorporated by reference herein in its entirety.

What is claimed is:

1. An image forming system, comprising:

a first image forming apparatus having: a first image forming portion configured to form an image; a first transfer unit configured to transfer, onto a recording material, the image formed by the first image forming portion; a first transfer power source configured to apply a voltage to the first transfer unit; and a first thermal fixing unit configured to thermally fix the image onto the recording material;

a second image forming apparatus having: a second image forming portion configured to form an image; a second transfer unit configured to transfer, onto a recording material, the image formed by the second image forming portion; a second transfer power source configured to apply a voltage to the second transfer unit; and a second thermal fixing unit configured to thermally fix the image onto the recording material;

a recording material containing portion configured to contain a recording material to be conveyed to the first transfer unit;

a conveying unit configured to convey the recording material from the first image forming apparatus to the second image forming apparatus;

a duplex image forming mode executing unit configured to execute:

a first duplex image forming mode in which the first image forming apparatus forms an image on one surface of the recording material which is conveyed from the recording material containing portion, and then the conveying unit conveys the recording material, and the second image forming apparatus forms an image on another surface of the recording material; and a second duplex image forming mode in which the second image forming apparatus sequentially forms images on one surface and another surface of a recording material which is conveyed from the recording material containing portion to the second image forming apparatus via the first image forming apparatus and the conveying unit;

a determining unit configured to determine whether or not the first image forming portion has run out of toner and whether or not the second duplex image forming mode is executable; and a control unit configured to control an absolute value of the voltage of the second transfer power source in a manner that, when the determining unit determines, during a period in which the duplex image forming mode executing unit executes the first duplex image forming mode, that the first image forming portion has run out of toner and that the second duplex image forming mode is executable, and when the duplex image forming mode executing unit changes over the first duplex image forming mode to the second duplex image forming mode to continue duplex image formation, the control unit makes an absolute value of the voltage of the second transfer power source when transferring the image onto the one surface of the recording material larger than an absolute value of the voltage of the first transfer power source in the first duplex image forming mode, and the control unit makes an absolute value of the voltage of the second transfer power source when transferring the image onto the another surface of the recording material larger than an absolute value of the voltage of the second transfer power source in the first duplex image forming mode.

2. An image forming system according to claim 1, wherein, in the second duplex image forming mode, the first image forming apparatus conveys the recording material without forming the image on the recording material.

3. An image forming system according to claim 1, wherein the first image forming apparatus further comprises a power feeding stopping unit configured to stop power feeding to the first thermal fixing unit, wherein the second image forming apparatus further comprises a voltage changing unit configured to change the voltage of the second transfer power source, and wherein the control unit causes the power feeding stopping unit to stop the power feeding to the first thermal fixing unit after the first duplex image forming mode is changed over to the second duplex image forming mode, and the voltage changing unit gradually reduces the absolute value of the voltage of the second transfer power source.

4. An image forming system according to claim 3, further comprising a temperature detecting unit configured to detect a temperature of the first thermal fixing unit, wherein the voltage changing unit controls the voltage of the second transfer power source based on the temperature detected by the temperature detecting unit.

5. An image forming system according to claim 1, wherein the second image forming apparatus further comprises a recording material containing cassette configured to contain a recording material to be conveyed to the second transfer unit, wherein the duplex image forming mode executing unit executes a third duplex image forming mode in which the second image forming apparatus sequentially forms images on one surface and another surface of the recording material which is conveyed from the recording material containing cassette, wherein the determining unit determines whether or not the third duplex image forming mode is executable, wherein, when the determining unit determines, during the period in which the duplex image forming mode executing unit executes the first duplex image forming mode, that the first image forming portion has run out of toner, that the second duplex image forming mode is inexecutable, and that the third duplex image forming mode is executable, the duplex image forming mode executing unit changes over the first duplex image forming mode to the third duplex image forming mode to continue the duplex image formation, and wherein the control unit makes the absolute value of the voltage of the second transfer power source when transferring the image onto the one surface of the recording material smaller than the absolute value of the voltage of the first transfer power source in the second duplex image forming mode, and the control unit makes the absolute value of the voltage of the second transfer power source when transferring the image onto the another surface of the recording material smaller than the absolute value of the voltage of the second transfer power source in the second duplex image forming mode.

* * * * *